US007051539B2

(12) United States Patent
Junge et al.

(10) Patent No.: US 7,051,539 B2
(45) Date of Patent: May 30, 2006

(54) CONVERTIBLE REFRIGERATOR-FREEZER

(75) Inventors: Brent A. Junge, Evansville, IN (US); Thomas Wesley Arent, St. Joseph, MI (US); Todd Christopher Starr, St. Joseph, MI (US); Brian J. Stewart, Vincennes, IN (US); Mark Allen Stout, Evansville, IN (US); Allan R. Steinkuhl, Evansville, IN (US); Duane A. Schmidt, Newburgh, IN (US); Quynh Hoang, Haubstadt, IN (US); Dan V. Orman, Newburgh, IN (US); Susan Ridgley Keil, Evansville, IN (US); Hairong H. Li, Newburgh, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 369 days.

(21) Appl. No.: 10/706,411

(22) Filed: Nov. 12, 2003

(65) Prior Publication Data

US 2004/0144128 A1 Jul. 29, 2004

Related U.S. Application Data

(60) Provisional application No. 60/437,120, filed on Dec. 30, 2002.

(51) Int. Cl.
*F25D 11/02* (2006.01)

(52) U.S. Cl. ..... 62/90; 62/187; 62/440

(58) Field of Classification Search ..... 62/89–90, 62/186–187, 440–441
See application file for complete search history.

(56) References Cited

U.S. PATENT DOCUMENTS

| | | | | |
|---|---|---|---|---|
| 3,411,312 | A | 11/1968 | Sigl et al. | 62/180 |
| 3,590,594 | A * | 7/1971 | Arend | 62/117 |
| 3,590,911 | A * | 7/1971 | Horvay | 165/263 |
| 3,601,463 | A | 8/1971 | Watt | 312/214 |
| 4,033,739 | A | 7/1977 | Ballarin | 62/202 |
| 4,467,618 | A * | 8/1984 | Gidseg | 62/187 |
| 4,614,092 | A | 9/1986 | Kim et al. | 62/408 |
| 4,638,644 | A | 1/1987 | Gidseg | 62/230 |
| 4,642,998 | A | 2/1987 | Kang et al. | 62/187 |
| 4,689,966 | A | 9/1987 | Nonaka | 62/187 |
| 5,375,428 | A | 12/1994 | LeClear et al. | 62/187 |
| 5,377,498 | A | 1/1995 | Cur et al. | 62/187 |
| 5,758,512 | A * | 6/1998 | Peterson et al. | 62/407 |
| 5,839,287 | A | 11/1998 | Stormo | 62/89 |
| 5,899,083 | A * | 5/1999 | Peterson et al. | 62/186 |
| 6,637,235 | B1 * | 10/2003 | Sakamoto et al. | 62/443 |
| 2003/0024254 | A1 * | 2/2003 | Yoshida et al. | 62/78 |
| 2004/0261444 | A1 * | 12/2004 | Chastine | 62/441 |

* cited by examiner

*Primary Examiner*—William E. Tapolcai
(74) *Attorney, Agent, or Firm*—Stephen Krefman; Robert O. Rice; Clifton G. Green

(57) ABSTRACT

A refrigerator freezer having an upper refrigerator compartment and a lower below freezing freezer compartment. The upper compartment can be a convertible compartment selectively operable by the user as an above freezing refrigerator compartment or as a below freezing freezer compartment. The evaporator for supplying refrigerated air is located in the upper compartment along with an auxiliary heater and upper compartment thermostat to control the temperature in the upper compartment. A control discharges an amount of refrigerated air to the upper compartment for refrigerator operation and a larger amount of refrigerated air for freezer operation. The control also energizes the auxiliary heater under control of the upper compartment thermostat during refrigerator operation to assure above freezing temperatures in the upper compartment. A low ambient heater can be provided for the upper compartment for use of the refrigerator freezer in low ambient temperature conditions such as an unheated garage.

38 Claims, 14 Drawing Sheets

CONVERTIBLE REFRIGERATOR-FREEZER

This application claims the benefit of Provisional application 60/437,120, filed Dec. 30, 2002.

BACKGROUND OF THE INVENTION

1. Field of the Invention

The invention relates to refrigerator-freezer with an upper compartment operable as an above freezing compartment and having the refrigerating system for the upper and lower compartments located in the upper compartment. The lower compartment can occupy more or less than half of the refrigerated volume and is operable as a below freezing compartment. The upper compartment can be convertible between operating as an above freezing refrigerator compartment or a below freezing freezer compartment. The refrigerator-freezer can include controls to selectively operate the upper compartment as a refrigerator compartment or a freezer compartment.

2. Description of the Related Art

Refrigerator-freezers having a compartment that can be operated at above freezing or below freezing temperatures are known. Refrigerators having multiple temperature evaporators to selectively operate multiple refrigerator compartments at different temperatures are also known.

SUMMARY OF THE INVENTION

In one embodiment of the invention a convertible refrigerator freezer having an insulated cabinet has an upper convertible compartment selectively operable by the user as an above freezing refrigerator compartment or as a below freezing freezer compartment, and a lower below freezing freezer compartment with insulation between the upper convertible compartment and the lower freezer compartment. A refrigerating system for the convertible refrigerator freezer includes an evaporator mounted adjacent the rear wall of the upper convertible compartment; an evaporator cover forming an evaporator compartment for separating the evaporator from the upper convertible compartment; an evaporator fan mounted in the evaporator compartment for drawing air from the lower freezer compartment through the insulation between the compartments and from the upper convertible compartment and circulating the air over the evaporator; an air tower for conveying refrigerated air from the evaporator fan to the lower freezer compartment through the insulation between the compartments; and a control for selectively discharging a first amount of refrigerated air through the evaporator cover to the upper convertible compartment when the control is set for operating the upper compartment as an above freezing refrigerator compartment, or a second larger amount of refrigerated air through the evaporator cover to the convertible compartment when the control is set for operating the upper convertible compartment as a freezer compartment.

In another embodiment of the invention a refrigerator freezer including an having cabinet has an upper compartment operable as an above freezing refrigerator compartment, and a lower below freezing freezer compartment having insulation between the upper compartment and the lower freezer compartment. A refrigerating system for the refrigerator freezer includes an evaporator mounted adjacent the rear wall of the upper compartment; an evaporator cover forming an evaporator compartment for separating the evaporator from the upper compartment; an evaporator fan mounted in the evaporator compartment for drawing air from the lower freezer compartment through the insulation between the compartments and from the upper compartment and circulating the air over the evaporator; a defrost heater adjacent the evaporator for periodically defrosting the evaporator; an air tower for conveying refrigerated air from the evaporator fan to the lower freezer compartment through the insulation between the compartments and to the upper compartment; a defrost control for periodically defrosting the evaporator during defrost cycles by energizing the defrost heater; and a control for adjusting the temperature of the upper compartment including an auxiliary heater for the upper compartment and connected in circuit with an upper compartment thermostat to maintain the upper compartment above freezing.

Another aspect of the invention is a convertible refrigerator freezer having an insulated cabinet that has an upper convertible compartment selectively operable by the user as an above freezing refrigerator compartment or as below freezing freezer compartment, and a lower below freezing freezer compartment and insulation between the upper convertible compartment and the lower freezer compartment. The refrigerating system for the convertible refrigerator freezer includes an evaporator mounted adjacent the rear wall of the upper convertible compartment; an evaporator cover forming an evaporator compartment for separating the evaporator from the upper convertible compartment; an evaporator fan mounted in the evaporator compartment for drawing air from the lower freezer compartment and from the upper convertible compartment and circulating the air over the evaporator; a defrost heater adjacent the evaporator for periodically defrosting the evaporator; an air tower for conveying refrigerated air from the evaporator fan to the lower freezer compartment through the compartment separator; a defrost control for periodically defrosting the evaporator; and a control for setting the convertible compartment to operate as an above freezing refrigerator or as a below freezing freezer. The control includes an air controller for selectively discharging a first amount of refrigerated air through the evaporator cover to the upper convertible compartment when the upper convertible compartment is operated as an above freezing refrigerator compartment, or a second larger amount of refrigerated air through the evaporator cover to the convertible compartment when the upper convertible compartment is operated as a below freezing freezer compartment; and an auxiliary heater for the convertible compartment and connected in circuit with a convertible compartment thermostat to maintain the convertible compartment above freezing when the control is set for refrigerator operation.

Another aspect of the invention is a convertible refrigerator freezer having an insulated cabinet that has an upper convertible compartment selectively operable by the user as an above freezing refrigerator compartment or as a below freezing freezer compartment, a lower below freezing freezer compartment and insulation and a compartment separator between the upper convertible compartment and the lower freezer compartment. An evaporator compartment in the rear of the upper convertible compartment is formed by an evaporator cover assembly spaced from the rear wall of the upper convertible compartment that includes an inner evaporator cover spaced inwardly from the rear wall of the convertible compartment; an air tower overlying the inner evaporator cover and connecting an opening in the inner evaporator cover to an opening in the compartment separator for supplying refrigerated air from the evaporator compartment to the freezer compartment; a sheet of insulation material overlying the inner evaporator cover and the air tower; an outer evaporator cover overlying the insulation material. The refrigerating system for the convertible refrigerator freezer includes an evaporator mounted in the evaporator compartment; an evaporator fan mounted in the evaporator compartment for drawing air from the lower freezer compartment through the compartment separator and from the upper convertible compartment and circulating the air over the evaporator and discharging refrigerated air into the air tower for cooling the freezer compartment and the convertible compartment. The refrigerator freezer includes a control for selectively discharging a first amount of refrigerated air from the air tower through the evaporator cover to the upper convertible compartment when the control is set to operate the convertible compartment as an above freezing refrigerator compartment, and for discharging a second larger amount of refrigerated air through the evaporator cover to the convertible compartment when the control is set to operate the convertible compartment as a below freezing freezer compartment.

Another aspect of the invention is a method of manufacturing (i) a refrigerator freezer product having an upper freezer compartment and a lower refrigerator compartment configuration, or (ii) a convertible refrigerator freezer product having an upper convertible compartment selectively operable as an above freezing refrigerator compartment or as a freezer compartment and a lower freezer compartment configuration utilizing a common platform. The method includes providing a common cabinet for use with both product configurations;

providing common compartment liners for use with both product configurations; providing a first compartment separator for use in the refrigerator freezer product configuration or a second compartment separator for use in the convertible refrigerator freezer product configuration; providing a first air system for supplying refrigerated air from an evaporator and evaporator fan in the upper freezer compartment to the upper freezer compartment and lower refrigerated compartment in the refrigerator freezer product configuration including an air tower for directing refrigerated air from the evaporator to the lower refrigerated compartment and to the upper freezer compartment, or providing a second air system for supplying refrigerated air from an evaporator and evaporator fan in the upper convertible compartment to the upper convertible compartment and to the lower freezer compartment in the convertible refrigerator freezer product configuration including an air tower for directing refrigerated air from the evaporator fan to the lower freezer compartment and a control for selectively directing a first amount of refrigerated air from the evaporator fan to the upper convertible compartment when the convertible upper compartment is operated as an above freezing refrigerator compartment, and a second larger amount of refrigerated air to the convertible compartment when the upper convertible compartment is operated as a freezer compartment.

Another aspect of the invention is a method of manufacturing (i) a refrigerator freezer product having an upper freezer compartment and a lower refrigerator compartment configuration, or (ii) a convertible refrigerator freezer product having an upper convertible compartment selectively operable as an above freezing refrigerator compartment or as a freezer compartment and a lower freezer compartment configuration utilizing a common platform and a common assembly process. The method includes fabricating a common cabinet for use with both product configurations; fabricating a common upper compartment liner and a common lower compartment liner for use in both product configurations; assembling a first compartment separator to the upper compartment liner for the refrigerator freezer product configuration, or assembling a second compartment separator to the upper compartment liner for the convertible refrigerator freezer product configuration; assembling a wiring harness in the common cabinet for connecting electrical components in the upper and lower compartment liners; assembling a first refrigerant line and heat loop set in the common cabinet for the refrigerator freezer product configuration, or assembling a second refrigerant line and heat loop set in the common cabinet for the convertible refrigerator freezer product configuration; assembling the upper compartment liner to the cabinet; assembling the lower compartment liner to the cabinet; providing foam in place insulation between the cabinet and the liners. Following foam in place insulation the method includes assembling a first refrigeration system including an evaporator, defrost heater, condenser and compressor in the refrigerator freezer product configuration, or a second refrigeration system including an evaporator, defrost heater, condenser and compressor in the convertible refrigerator freezer product configuration; assembling a first evaporator cover including an air tower for transmitting refrigerated air to the lower refrigerator compartment and to the upper freezer compartment in the refrigerator freezer product configuration, or a second evaporator cover assembly including an inner evaporator cover, an air tower for transmitting refrigerated air from the evaporator fan to the lower freezer compartment, a sheet of insulation material and an outer evaporator cover in the convertible refrigerator freezer product configuration; and assembling a first control for controlling operation of a refrigerator freezer product configuration, or a second control for controlling operation of a convertible product configuration wherein the second control includes an air controller for selectively directing a first amount of refrigerated air from the evaporator fan to the upper convertible compartment for operation as a refrigerator, or a second larger amount of refrigerated air to the convertible compartment for operation as a freezer. Following completion of the refrigeration system and control the method includes assembling a common lower compartment door and door liner and assembling a common upper door having a first inner door for the refrigerator freezer product configuration, or a common upper door having a second inner door for the convertible refrigerator freezer product configuration.

DESCRIPTION OF THE INVENTION

In accordance with the present invention a refrigerator freezer product is provided with a lower compartment that is a freezer compartment. The upper compartment can be a fresh food, above freezing, compartment or can be convertible by the user between an above freezing fresh food compartment and a below freezing freezer compartment. A refrigerator freezer according to the invention can serve a function similar to a vertical freezer. But, unlike existing vertical freezers, the convertible refrigerator freezer has a separate upper compartment that can be easily converted by the user to above freezing fresh food storage. This product configuration gives the consumer the flexibility to obtain extra fresh food storage for example in the summer to keep extra drinks or extra fresh food from the kitchen refrigerator cold. In the winter or after shopping at a wholesale club the upper compartment can easily be converted to a freezer compartment for extra frozen food storage. The refrigerator freezer according to the invention is also capable of operation in locations that are not climate controlled such as a basement or garage and yet maintain satisfactory fresh food compartment temperatures when the ambient temperature around the refrigerator freezer is near or below freezing. The convertible refrigerator freezer according to this invention can be provided with doors having an ornamental treadplate pattern on the outer surface of the doors that is the subject matter of co-pending design patent application US20020317 filed on Dec. 30, 2002.

Figure 1:
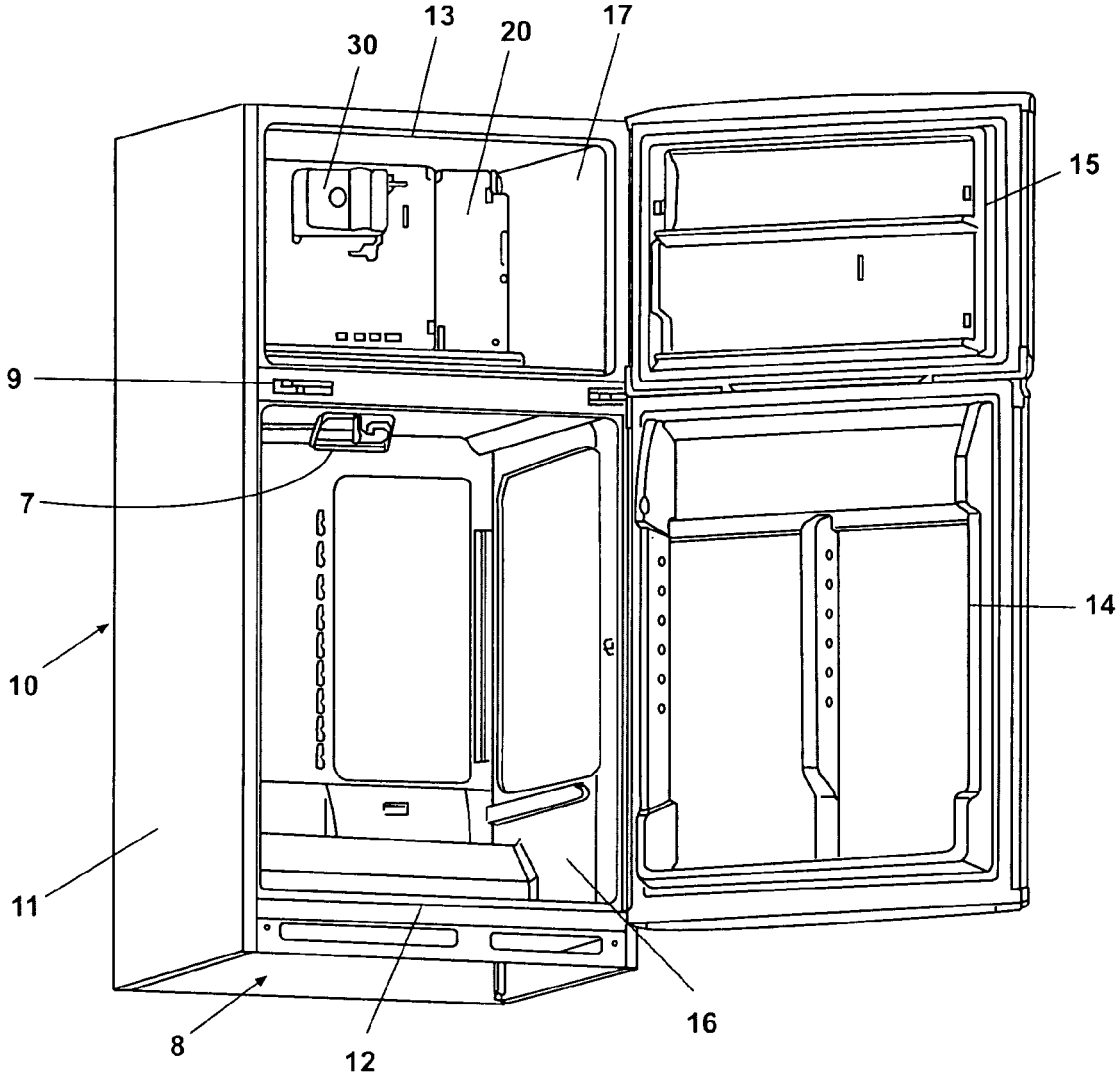
FIG. 1 is a front perspective view of a refrigerator freezer according to the invention.

Turning to FIG. 1, a refrigerator freezer 10 according to the invention is shown. The refrigerator freezer 10 can have a conventional cabinet 11 and can include a lower freezer compartment 12 and an upper refrigerator or convertible refrigerator/freezer compartment 13. The volume of the lower freezer compartment 12 can be 60–80% of the refrigerated volume. If desired, the relative volume of the lower freezer compartment 12 can be less than 50% of the refrigerated volume within the scope of the invention. In the embodiment shown in FIG. 1 the lower freezer 12 compartment comprises approximately 70% of the refrigerated volume while the upper compartment 13 comprises approximately 30% of the refrigerated volume. Those skilled in the art will recognize that the 70%–30% proportion of the lower and upper compartments can be changed as desired. In this embodiment the relative volumes of the upper and lower compartments were selected to be the same as a base model refrigerator freezer from which the convertible refrigerator freezer is derived. Lower compartment 12 can have a lower compartment liner 16 that can be thermoformed of plastic material that can be high impact polystyrene (HIPS) as is well known in the art. Likewise, upper compartment 13 can have an upper compartment liner 17 that can be thermoformed of plastic material that can be HIPS as is well known in the art. The refrigerator freezer can have a hinged door 14 for lower compartment 12 and a hinged door 15 for the upper compartment 13 as is well known to those skilled in the art. Upper door 15 and lower door 14 can have shelves and racks (not shown) carried on the inner door panels to store containers and packages to be refrigerated as is well known to those skilled in the art. The upper door 15 can be provided with a beverage rack (not shown) having an ornamental design that is the subject matter of design patent U.S. D479,537 incorporated herein by reference. Various shelves and racks can be provided on the doors as is well known to those skilled in the art.

Figure 2:
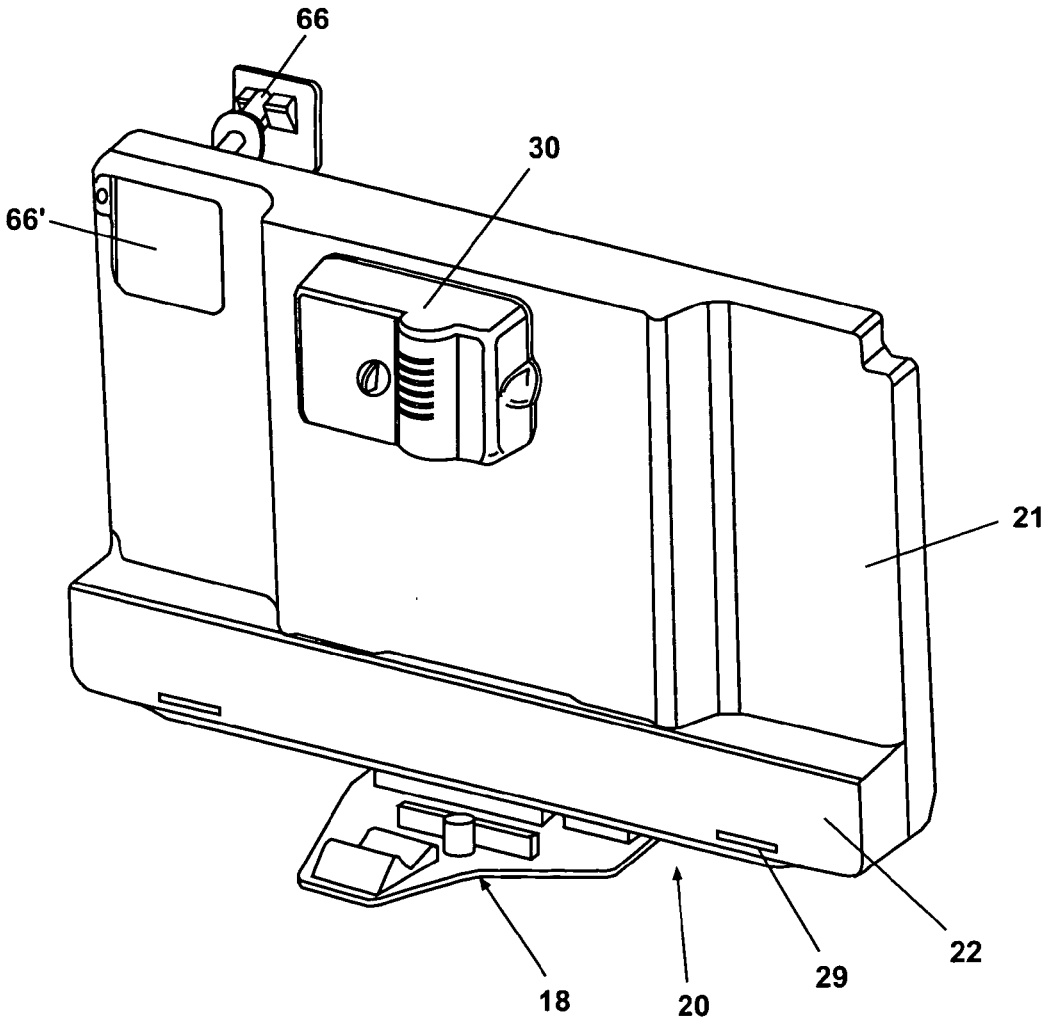
FIG. 2 is a front perspective view of the evaporator cover assembly removed from refrigerator freezer.
Figure 3:
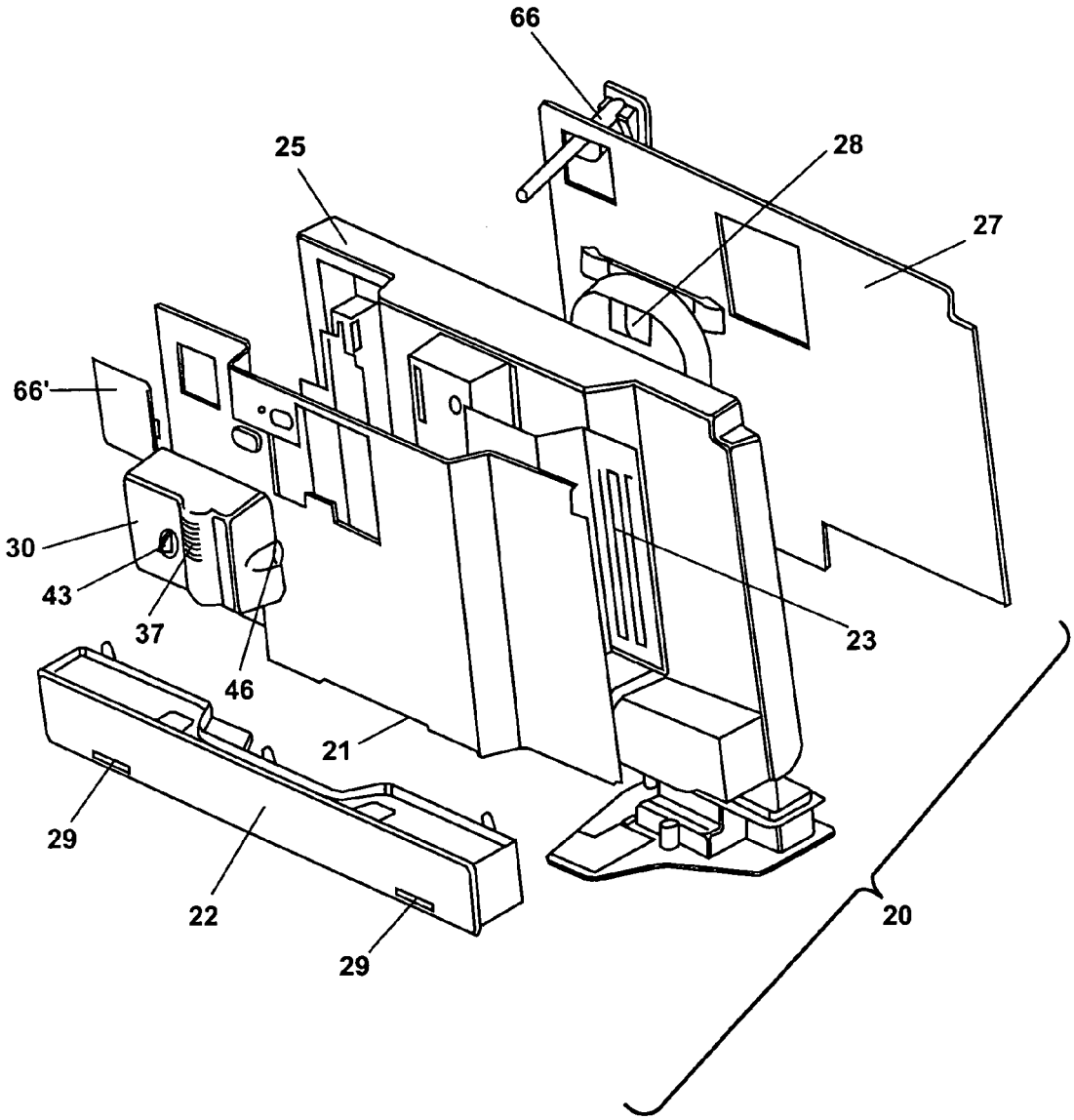
FIG. 3 is an exploded front perspective view of the evaporator cover assembly removed from the refrigerator freezer.

According to one embodiment of the invention, lower compartment 12 is a freezer compartment arranged to provide below freezing temperatures for storing frozen food. Upper compartment 13 can be converted by the user to operate as a fresh food compartment, with above freezing temperatures, or as an additional, below freezing, freezer compartment. Referring to FIG. 2, an evaporator cover assembly 20 is shown removed from the refrigerator freezer. Evaporator cover assembly 20 forms an evaporator compartment 19 (see FIG. 4) by closing off the rear portion of upper compartment 13 as is well known to those skilled in the art. Evaporator cover assembly 20 is shown removed from the refrigerator freezer and exploded in FIG. 3 and FIG. 4 to show the components of the evaporator assembly. Evaporator cover assembly 20 can include an inner evaporator cover 27, an air tower 26, insulation 25, auxiliary heater 23 and an outer evaporator cover 21 as will be described below. Shown positioned below evaporator cover assembly 20 is compartment separator 18. In an assembled refrigerator freezer according to the invention compartment separator 18 is positioned between upper compartment liner 17 and lower compartment liner 16 and can have passages for refrigerated air from the evaporator to the lower compartment 12 and for return air to the evaporator through the insulation between the upper compartment 13 and the lower compartment 12 as will be explained below. Compartment separator 18 is shown in FIG. 2, FIG. 3 and FIG. 4 to facilitate understanding of air flow through the evaporator compartment.

The evaporator cover assembly can include a control 30 mounted on the outer surface of an outer evaporator cover 21. Evaporator cover 21 can be formed of pre-painted galvanized steel. An upper compartment drain pan 22 can be positioned at the bottom of outer evaporator cover 21 and against the bottom surface of the upper compartment liner 17. Upper compartment drain pan 22 can be formed of HIPS. An auxiliary heater 23 can be provided for the upper compartment. Auxiliary heater 23 can be formed by laminating an electric heater wire 24 between sheets of aluminum foil. One of the sheets of aluminum foil can have adhesive on one surface to hold heater wire 24 in position during the lamination process. Auxiliary heater 23 can have adhesive on one surface to adhere auxiliary heater 23 to the inside surface of outer evaporator cover 21. Alternately, auxiliary heater 23 could be adhered to insulation panel 25 or could be sandwiched between outer evaporator cover 21 and insulation panel 25, or could otherwise be located in the upper compartment as will be readily understood by one skilled in the art. In the embodiment of FIG. 1–FIG. 7, auxiliary heater 23 can be a 60 watt heater. Those skilled in the art with understand that the resistance of auxiliary heater 23 can be adjusted as desired to provide adequate heat to maintain the temperature in convertible compartment 13 at a selected temperature when the user has set the control for refrigerator operation. Likewise those skilled in the art will recognize that auxiliary heater 23 can take the form of other known heaters for use in a refrigerated space and is not limited to heater wire laminated between sheets of aluminum foil. Panel 25 can be formed of molded expanded polystyrene as is well known to those skilled in the art. Panel 25 can include a recess on the rear side to accommodate an air tower 26, that can be formed of polypropylene, for conducting refrigerated air from the evaporator compartment 19 to lower compartment 12. An inner evaporator cover 27, that can be formed of pre-painted galvanized steel, can be positioned behind insulation panel 25. Evaporator cover assembly 20 can form an air system for the circulation of refrigerated air from the evaporator compartment 19 to the upper and lower compartments and for return air from the upper and lower compartments to the evaporator compartment in cooperation with compartment separator 18. The air system can include inner evaporator cover 27, air tower 26, insulation 25, outer evaporator cover 21, and control 30. Movement of air through the air system is described in more detail below.

Figure 4:
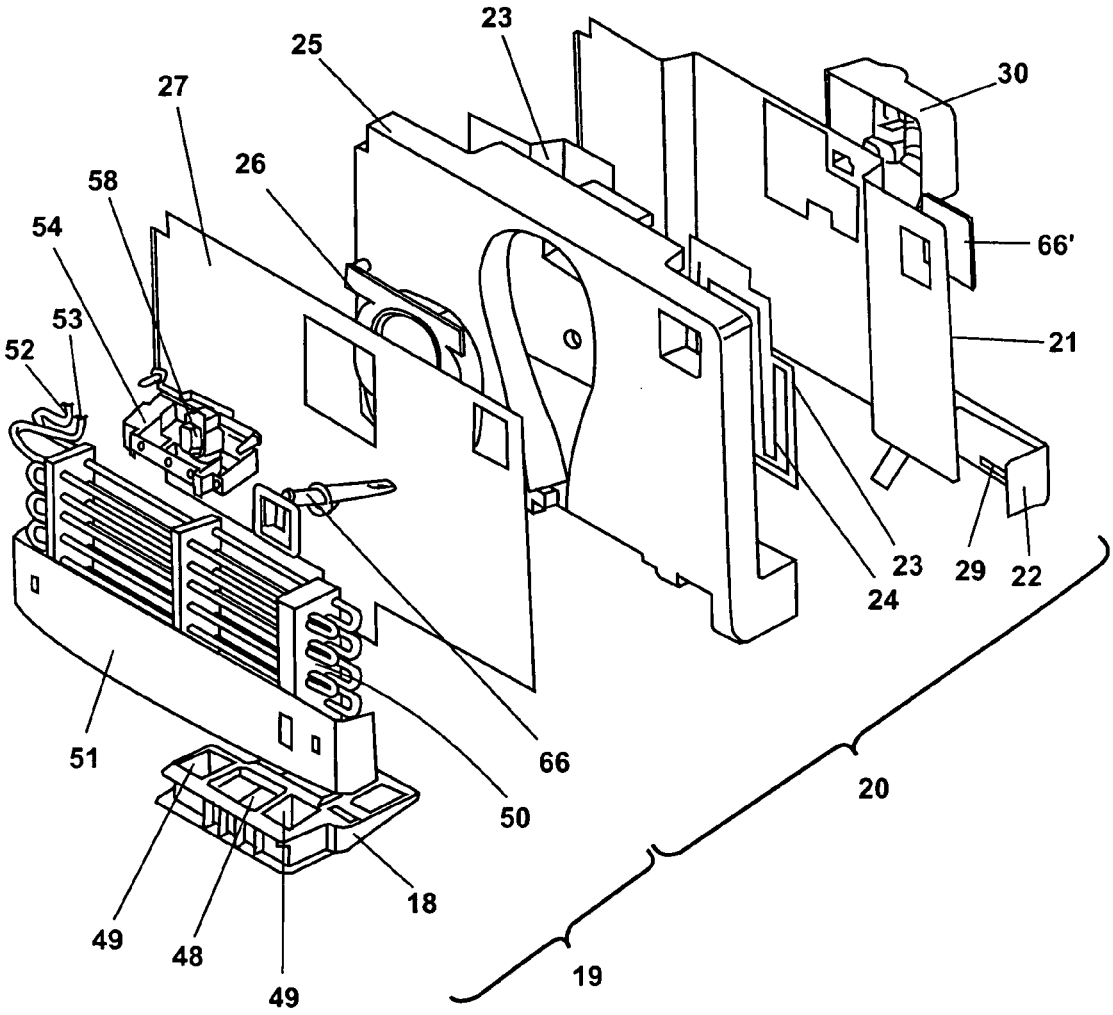
FIG. 4 is an exploded rear perspective view of the evaporator and evaporator cover assembly removed from the refrigerator freezer.

Referring to FIG. 4, an evaporator 50 can be positioned in evaporator compartment 19 defined by evaporator cover assembly 20 and the rear wall of upper compartment liner 17. A mounting bracket 51 can be used to mount evaporator 50 to the rear wall of the upper compartment liner. Evaporator 50 can be a conventional tube and fin evaporator as is well know to those skilled in the art. Evaporator 50 can be connected to the refrigeration system for the refrigerator freezer by tubes 52 and 53 as is well known to those skilled in the art. Tubes 52 and 53 connect the evaporator 50 to a compressor, not shown, a condenser, not shown and an expansion device, not shown, to form the refrigeration system as is well known to those skilled in the art. Evaporator 50 can be provided with a defrost heater, not shown, that can be mounted at the bottom of the evaporator to periodically defrosting the evaporator as is well known to those skilled in the art. In the embodiment of FIG. 1–FIG. 7A, the defrost heater 56 (shown in FIG. 9) can be a 425 watt heater. Those skilled in the art will understand that the resistance of the defrost heater can be adjusted to provide adequate heat to defrost evaporator 50 in a satisfactory time period. Mounting bracket 51 can also function as a heat shield to shield the upper compartment liner from the defrost heater. Mounting bracket 51 can also function as an evaporator drain pan to collect frost and ice melted off evaporator 50 during defrost cycles.

An evaporator fan assembly 54 can be mounted above evaporator 50 for moving air through the air system. Evaporator fan assembly 54 can be mounted to the rear wall of upper compartment liner 17 as is well known to those skilled in the art. Evaporator fan assembly 54 can draw air up through evaporator 50 and discharge the refrigerated air into the air system formed by the evaporator cover assembly 20 and fan tower 26. Fan tower 26 can direct refrigerated air downward into lower compartment 12 through compartment separator 18 through air passage 48. Fan tower 26 can have an air passage 28 that can allow refrigerated air to move forward through fan tower and insulation panel 25 into control 30 as will be described in more detail below. Evaporator fan assembly 54 can draw air into evaporator compartment 19 through return air passages 29 in upper compartment drain pan 22 from upper compartment 13 and through return air passages 49 in compartment separator 18 from lower compartment 12.

Suitable refrigerant lines (not shown) and wiring harnesses (not shown) can be provided to connect refrigeration system and electrical components in upper compartment 13 and lower compartment 12 with refrigeration system and electrical components located in the machinery compartment 8 in the bottom rear of the cabinet as is well known to those skilled in the art. An optional ice maker fill tube assembly 66 can be provided in the rear wall of upper compartment liner 17 that can pass through openings in the inner evaporator cover 27, insulation panel 25, and outer evaporator cover 21. A cover 66' can be provided to close the opening in outer evaporator cover 21 until an ice maker is installed as is well known to those skilled in the art.

Figure 5:
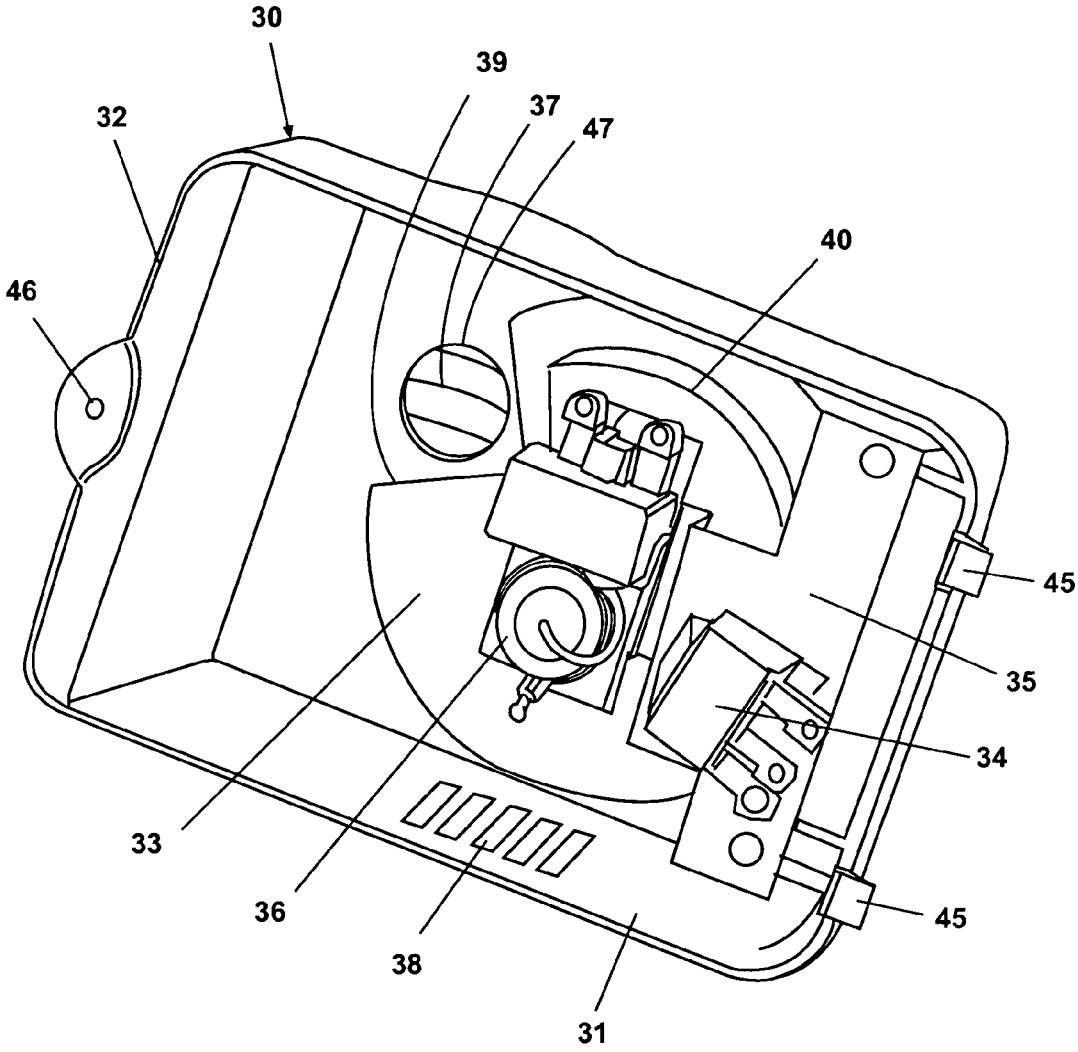
FIG. 5 is a rear perspective view of the control removed from the evaporator cover of the refrigerator freezer.
Figure 6:
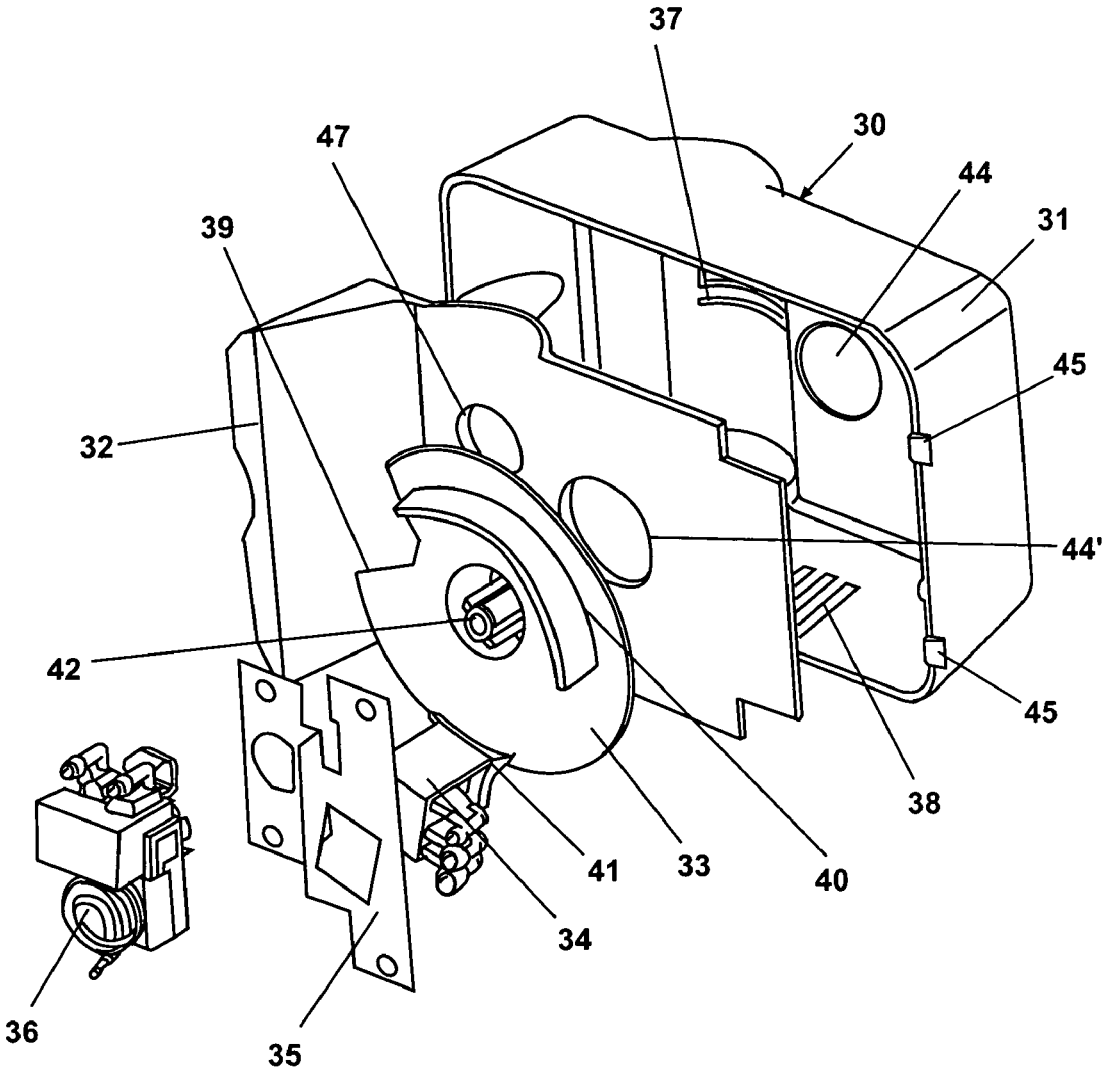
FIG. 6 is an exploded rear perspective view of the control of the refrigerator freezer.

Referring to FIG. 5 and FIG. 6 the control 30 can be seen removed from evaporator cover assembly 20. Control 30 can include a control cover 31 arranged to be detachably mounted on outer evaporator cover 21. Control cover 31 can be formed of molded plastic material. Control 30 can be mounted to outer evaporator cover 21 by mounting tabs 45 formed as part of control cover 31 and a mounting screw fastened through mounting screw hole 46 on the opposite side of control cover 31. Those skilled in the art will recognize that other mounting mechanisms can be provided as desired. A block of insulation 32 can be provided for the inside surface of control cover 31 to prevent cover 31 from attaining below freezing temperatures during operation of upper compartment 13 as a fresh food compartment and thereby prevent formation of frost on the surface of control cover 31. Insulation block 32 can be formed of expanded polystyrene and can form an air passage 47 for refrigerated air discharged into control 30 by evaporator fan assembly 54. Air passage 47 terminates adjacent louvers 37 to discharge refrigerated air into upper compartment 13 under control of an air controller, control baffle 33, as will be described in detail below. Switch 34 and upper compartment thermostat 36 can be mounted on bracket 35. Switch 34 and thermostat 36 can be mounted to bracket 35 with fasteners or by locking tabs as is well known to those skilled in the art. Bracket 35 can be mounted to control cover 31 by suitable fasteners as is well known to those skilled in the art. Control cover 31 can also have louvers 38 for discharging refrigerated air from control 30 into upper compartment 13. In the embodiment shown in FIG. 5 and FIG. 6, louvers 38 are not controlled by the air controller, control baffle 33, thereby allowing some refrigerated air present in control 30 to pass into upper compartment 13 regardless of the setting of control baffle 33.

Referring again to FIG. 5 and FIG. 6, the operation of control baffle 33 as an air controller can be understood. Control baffle 33 can be molded of plastic material and can include a manually operable control knob 43 on the outside surface of control baffle 33 (see FIG. 3) that can pass through opening 44 in control cover 31 and a corresponding opening 44' in insulation block 32. Control baffle 33 can also include a cutout 39 on one sector of the generally circular baffle. When cutout 39 is partially or fully aligned with air passage 47 in insulation block 32 refrigerated air discharged into control 30 by the evaporator fan assembly 54 can pass through air passage 47 and through louvers 37 into upper compartment 13 (see FIG. 5). Control baffle 33 can be rotated by turning control knob 43 to rotate cutout 39 out of alignment with air passage 47. When control baffle 33 is rotated such that cutout 39 is not partially or fully in alignment with air passage 47, refrigerated air discharged into control 30 can not be discharged through louvers 37, but only through louvers 38 into upper compartment 13. The reduced airflow into upper compartment 13 through control 30 by operation of the air controller, control baffle 30, can allow the temperature in upper compartment 13 to rise above freezing for operation of upper compartment 13 as a fresh food compartment. When control baffle 33 is positioned to allow airflow through air passage 47 and thereby through louvers 37, sufficient refrigerated air will flow into upper compartment 13 to cause compartment 13 to be a freezer compartment with temperatures comparable to lower compartment 12.

Control baffle 33 can also carry a curved upstanding cam 40 on the inside surface of the control baffle. Cam 40 can be positioned on control baffle 33 so that as control baffle 33 is rotated by control knob 43, cam 40 can be rotated into position where cam 40 engages the rocker arm 41 of switch 34 to actuate switch 34. The function of switch 34 will be described below. Control baffle 33 can also include a drive shaft 42 arranged to engage upper compartment thermostat 36 to allow adjustment of the temperature at which thermostat 36 operates. Thus, control baffle 33 can provide three functions, an air controller to control air flow through louvers 37, a switch operator to operate switch 34 and a thermostat adjuster to adjust thermostat 36 in order to control operation of upper compartment 13 as a fresh food compartment or a freezer compartment.

Figure 9:
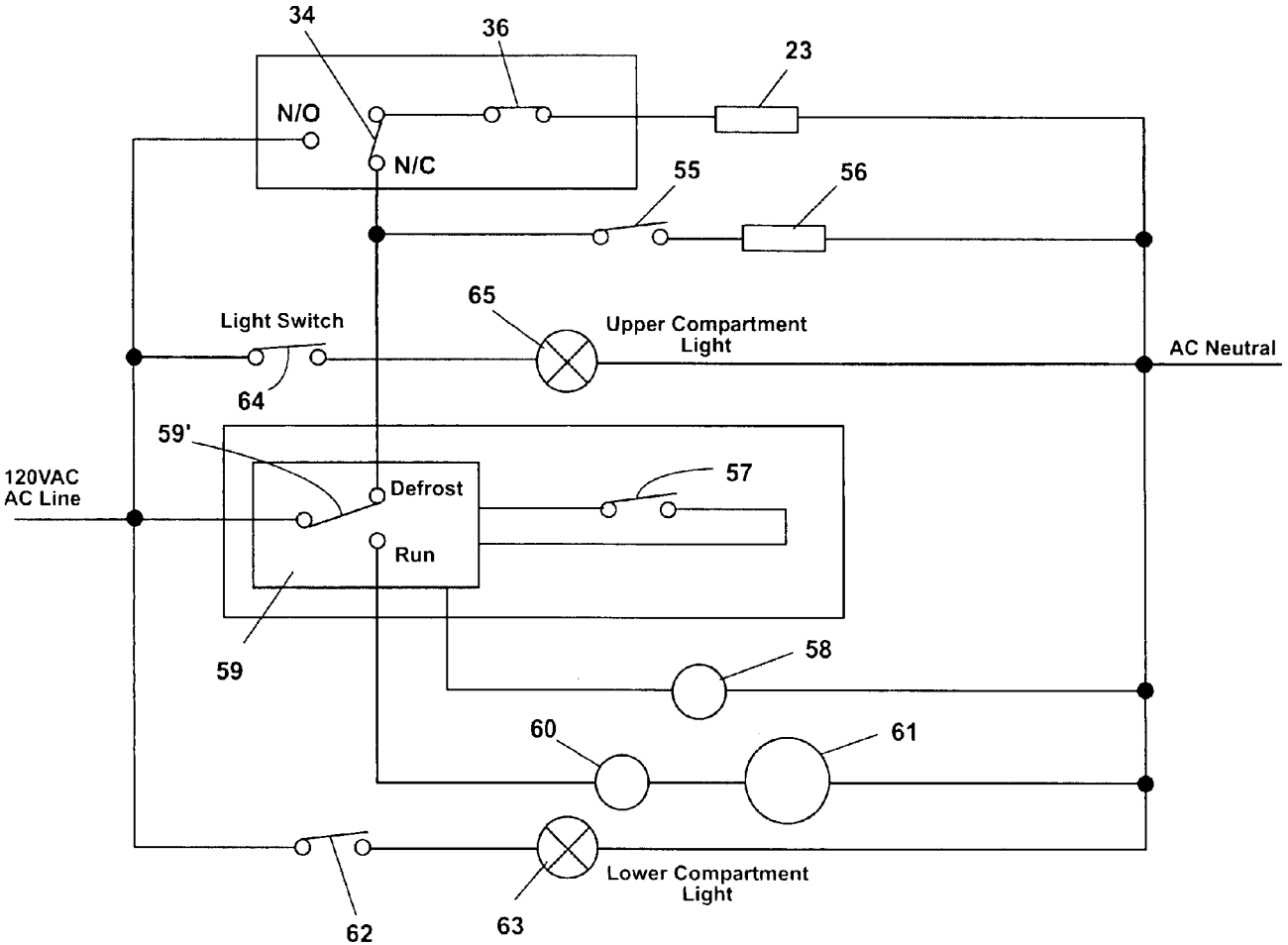
FIG. 9 is a circuit diagram for the refrigerator freezer.
Figure 10:
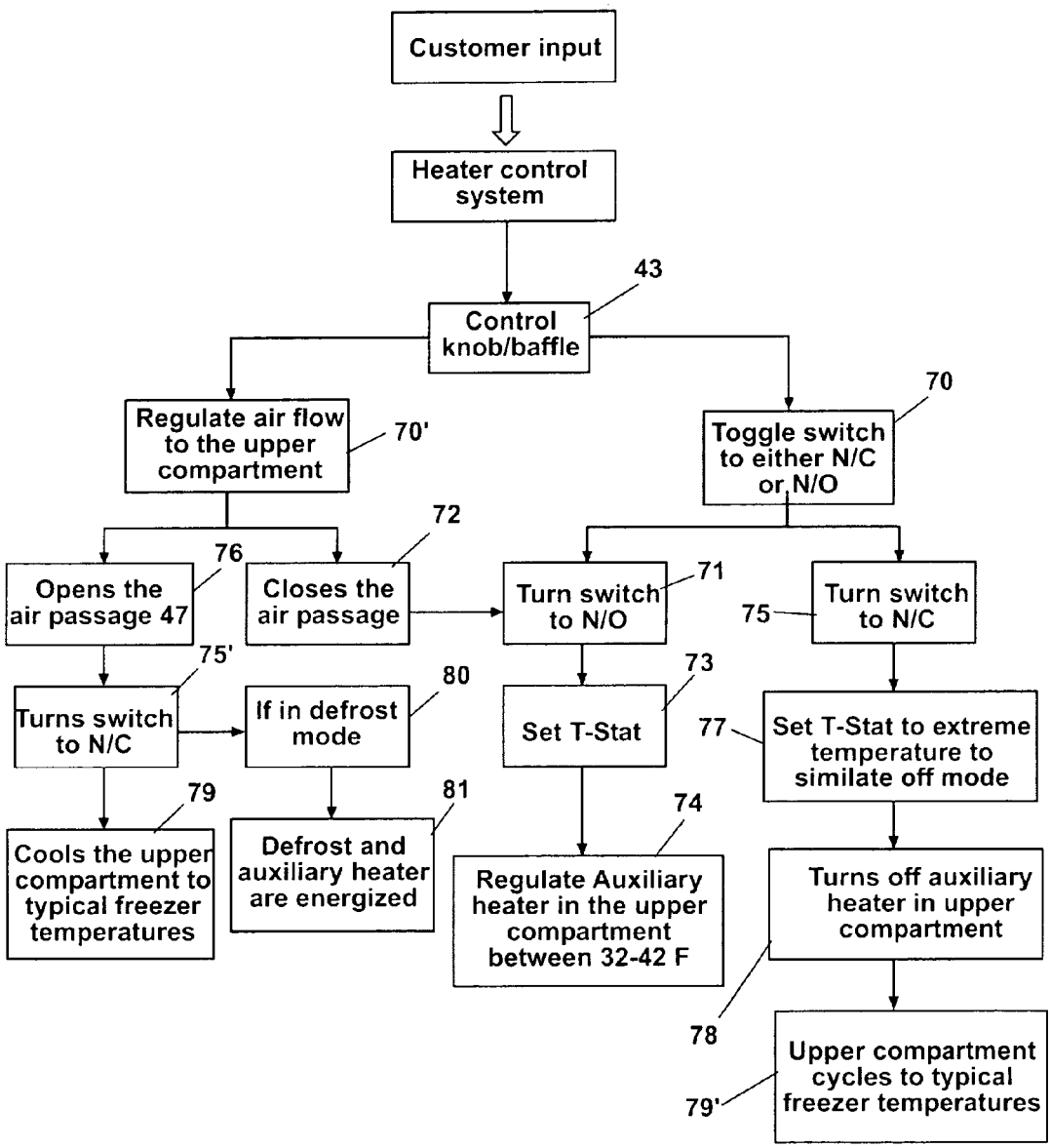
FIG. 10 is a flowchart showing the effect of operating the control between refrigerator and freezer settings.

Referring to FIG. 9 and FIG. 10 operation of the control 30 to operate upper compartment as a fresh food or as a freezer compartment can be described. The control circuit for the convertible refrigerator freezer is shown in FIG. 9. A first circuit can be connected between line voltage and neutral including a conventional automatic defrost control 59 and a lower compartment thermostat 57. Automatic defrost control 59 and lower compartment thermostat 57 can be located in lower compartment as is well known to those skilled in the art. In the embodiment of FIG. 1, the automatic defrost control and thermostat 57 can be located in control housing 7 located on the top wall of lower compartment liner 16. When thermostat 57 closes calling for cooling in lower compartment 12, condenser fan motor 60 and compressor motor 61 can be energized, and evaporator fan motor 58 can be energized after a delay to allow evaporator 50 to be chilled to operating temperature. The operation of the automatic defrost control 59 and lower compartment thermostat 57 to control the temperature in lower compartment are well known to those skilled in the art. When automatic defrost control 59 calls for defrosting, the switch 59' transfers to the defrost terminal energizing defrost heater 56 through defrost thermostat 55 as is well know to those skilled in the art.

Control switch 34, upper compartment thermostat 36 and auxiliary heater 23 can also be connected in a circuit between line voltage and neutral. Control switch 34 has a normally closed (N/C) terminal and a normally open (N/O) terminal. As mentioned above, control knob 43 can be arranged to operate control switch 34 by means of cam 40 on the back side of control baffle 33. Conventional lights 63 and 65 and light switches 62 and 64 for the upper and lower compartment can be connected between line voltage and neutral as is well known to those skilled in the art.

Referring to FIG. 10, the function of the control circuit for auxiliary heater 23 is shown in block diagram form. When control knob 43 is rotated to the refrigerator setting position, blocks 70 and 70', control knob 43 can position control switch 34 to complete a circuit connecting terminal N/O to upper compartment thermostat 36, block 71, and control baffle 33 can close air passage 47 reducing the flow of refrigerated air into upper compartment 13, block 72. As described above, control baffle 33 closes air passage 47 by rotating cutout 39 out of alignment with air passage 47. Rotation of control knob 43 to the refrigerator position can also rotates drive shaft 42 to operate adjustable thermostat 36 for operation at above freezing temperatures, block 73. For example, thermostat 36 can be arranged to control upper compartment temperatures between 32°–42° F. when control knob 43 is set for refrigerator operation, block 74. When the temperature in upper compartment 13 falls below the set point of thermostat 36, auxiliary heater 23 is energized causing auxiliary heater 23 to add heat to upper compartment 13. Auxiliary heater 23 can operate until the temperature in upper compartment 13 rises to the point that thermostat 36 opens causing heater to be de-energized until the temperature in upper compartment falls to the point that thermostat 36 again closes. Upper compartment thermostat 36 can operate auxiliary heater 23 to provide heat to upper compartment 13 regardless of the ambient temperature around the refrigerator freezer. Thus, auxiliary heater 23 can provide heat to prevent the temperature in upper compartment 13 from falling below freezing even if the ambient temperature outside the refrigerator is near or below freezing.

When control knob 43 is rotated to a freezer setting position, block 70 and 70', control knob 43 rotates control baffle 33 to position cam 40 so that switch 34 reverts to the N/C position, block 75 and block 75', and positions cutout 39 to be partially or fully aligned with air passage 47 and louvers 37 thus increasing refrigerated airflow into upper compartment 13, block 76. Upper compartment thermostat 36 is adjusted to assure thermostat 36 will remain closed to connect the N/C terminal of switch 34 to the auxiliary heater 23, block 77. With control switch 34 in the N/C position auxiliary heater 23 is normally de-energized so that no additional heat is added to upper compartment 13, block 78. Thus, the temperature in upper compartment 13 will fall to substantially the same below freezing temperature as in lower compartment 12 under control of lower compartment thermostat 57, blocks 79 and 79'. When automatic defrost control 59 initiates a defrost cycle with upper compartment 13 operating as a freezer, block 80, defrost heater 56 is energized through defrost bi-metal 55. As is well known to those skilled in the art, a defrost bi-metal thermostat can be located in evaporator compartment 19 in a position to sense the temperature at which frost has been removed from evaporator 50. Referring to FIG. 9, when control knob 43 is set to the freezer position and switch 34 is in the N/C position, upper compartment thermostat 36 and auxiliary heater 23 are energized by the automatic defrost control 59, block 81. Thus, until upper compartment thermostat 36 opens, auxiliary heater 23 will be energized in addition to defrost heater 56. Energization of auxiliary heater 23 during a defrost cycle in freezer mode operation assures that any frost or ice that may have accumulated on the evaporator cover assembly 20, and outer evaporator cover 21 including the air passages and louvers in control 30 will be melted. Any water resulting from melting frost can run down the evaporator cover to be collected by the upper compartment drain pan 22. Should the temperature in upper compartment 13 rise above the upper compartment thermostat 36 set point during an defrost cycle in the freezer mode of operation, thermostat 36 will open terminating the operation of auxiliary heater 23 in that defrost cycle.

A benefit of locating the evaporator 50 in upper compartment 13 is that frozen food stored in lower compartment 12 is not subject to above freezing temperatures as can occur in upper compartment 13 during a defrost cycle in conventional top freezer refrigerator freezers, or in conventional upright frostless freezers. While defrost cycles in conventional refrigerator freezers or conventional upright freezers do not cause frozen food stored in the freezer to defrost, the surface of some packages of food can rise to near or above freezing temperatures during defrost cycles that can impair the overall satisfactory storage life of such food products. Since lower compartment 12 is the primary frozen food storage compartment, improved frozen food storage can be achieved in lower compartment 12. When upper compartment 13 is operated as a refrigerator compartment the heat resulting from a defrost cycle does not impair fresh food stored in upper compartment 13 since temperatures do not increase enough to impair storage life of the above freezing refrigerated items. When upper compartment 13 is operated as a freezer compartment food stored in the upper compartment can be subjected to above freezing temperatures during defrost cycles. However, upper compartment 13 is intended as auxiliary, not long term frozen food storage so any impairment in satisfactory storage will be inconsequential.

Figure 6A:
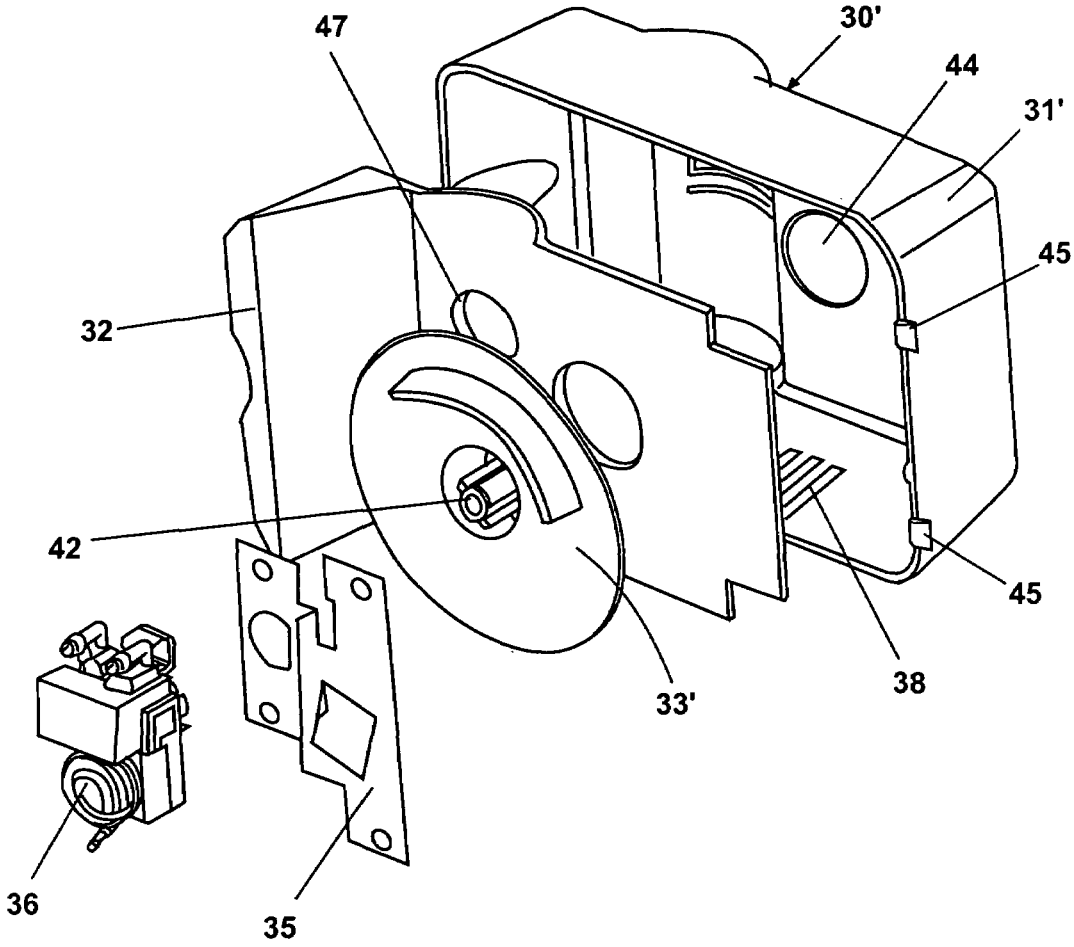
FIG. 6A is an exploded rear perspective view of the control of an "always refrigerator" upper compartment embodiment of the refrigerator freezer.
Figure 9A:
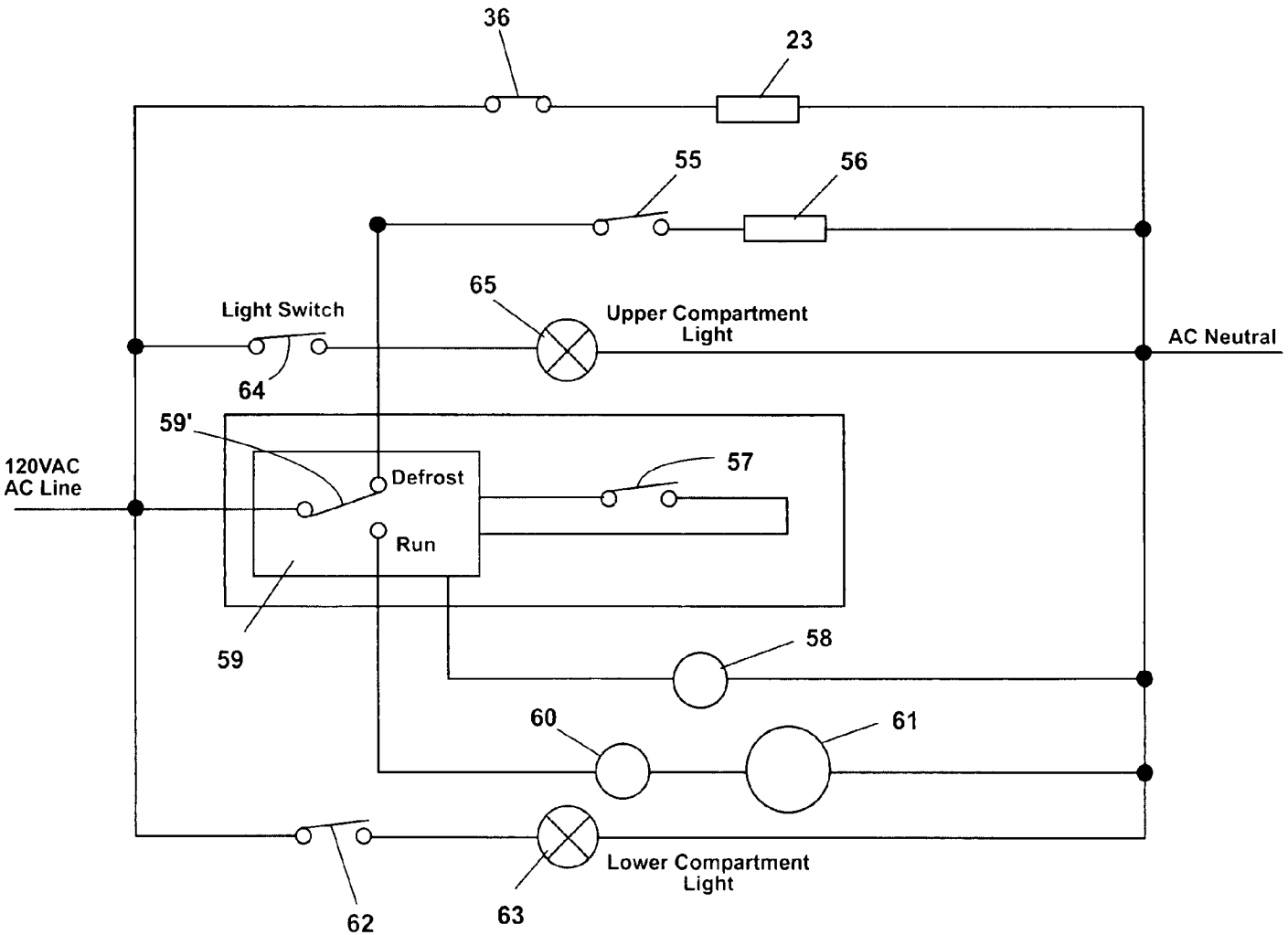
FIG. 9A is a circuit diagram for the "always refrigerator" upper compartment embodiment of the refrigerator freezer.

Referring to FIG. 6A and FIG. 9A, refrigerator freezer 10 can be arranged to have an upper fresh food compartment 13 and a lower frozen food compartment 12. To provide an "always refrigerator" upper compartment 13, auxiliary heater 23 can be connected to line voltage through upper compartment thermostat 36 eliminating control switch 34 that can be used in the convertible embodiment. In addition, control baffle 33' need not include a cutout 39, and control cover 31' need not include controlled air passage louvers 37 each as in the case of the convertible embodiment. In operation, an "always refrigerator" upper compartment embodiment can have refrigerated air circulated by evaporator fan assembly 54 through air tower 26 into control 30' and through louvers 38 into upper compartment 13. Upper compartment thermostat 36 can operate auxiliary heater 23 to control temperatures in upper compartment 13 just as in the convertible compartment embodiment. The "always refrigerator" upper compartment embodiment provides the same lower freezer compartment benefits noted above with respect to frozen food storage.

In order to improve operation of the convertible refrigerator freezer when it is installed in potential low ambient temperature conditions such as in a garage or other non-climate controlled location, the compressor 61 can be provided with means to facilitate starting in low ambient temperature conditions as is well known to those skilled in the art. A crankcase heater and thermostat (not shown), or a suction line accumulator (not shown) can be used to facilitate operation in low ambient temperature conditions by protecting the compressor from liquid refrigerant return during operation in low temperature ambient conditions.

Figure 7A:
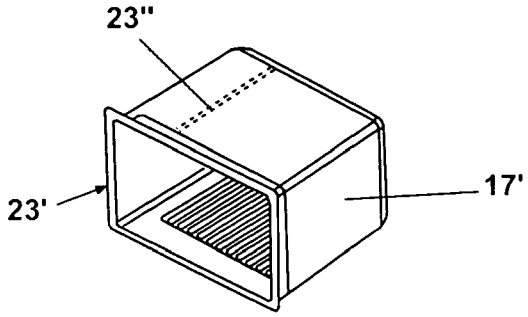
FIG. 7A is a front perspective view showing an another embodiment of the upper compartment liner removed from the refrigerator freezer showing the location of low ambient heaters on the sides of the upper compartment liner.

The convertible upper compartment can be provided with additional low ambient heaters to help assure that temperatures in the upper compartment remain above freezing when the convertible refrigerator freezer is set for refrigerator operation and is operating in low ambient temperature conditions, such as in a garage or other non-climate controlled location. The upper compartment liner 17', shown in FIG. 7A, can have low ambient foil heaters 23' provided on the side walls of the liner 17' adjacent the front flange. Low ambient foil heaters 23' can be provided in addition to auxiliary heater 23 in the evaporator cover assembly as described above. The low ambient foil heaters 23' can be well known heater wires held in place on the outside surface of the upper compartment liner 17' by adhesive backed foil holding the heater wires in place on the foil and the foil on the liner 17'. The low ambient foil heaters 23' can be connected by wires 23" leading the rear of the cabinet for connection to the convertible refrigerator freezer wiring harness as is well known in the art. Once the cabinet and liners are assembled as described below, foam insulation will hold the low ambient heaters in position on upper compartment liner 17'. While two low ambient heaters 23' are shown in FIG. 7A, those skilled in the art will understand that one or more than two heaters can be arranged on upper compartment liner 17' to provide heat in the upper compartment during low ambient operation. The low ambient heaters can be 9 watts each for a total of 18 watts. Those skilled in the art with understand that the wattage of low ambient heaters 23' can be adjusted as desired to provide adequate supplemental heat to maintain the temperature in convertible compartment 13 at above freezing temperatures when the convertible refrigerator is operating in low ambient temperature conditions. Likewise, those skilled in the art will understand that the low ambient heaters 23' can be formed of other known heater materials used for providing heat in refrigerated spaces and can be located other than on the outside surface of the upper compartment liner as shown in this embodiment.

Figure 9B:
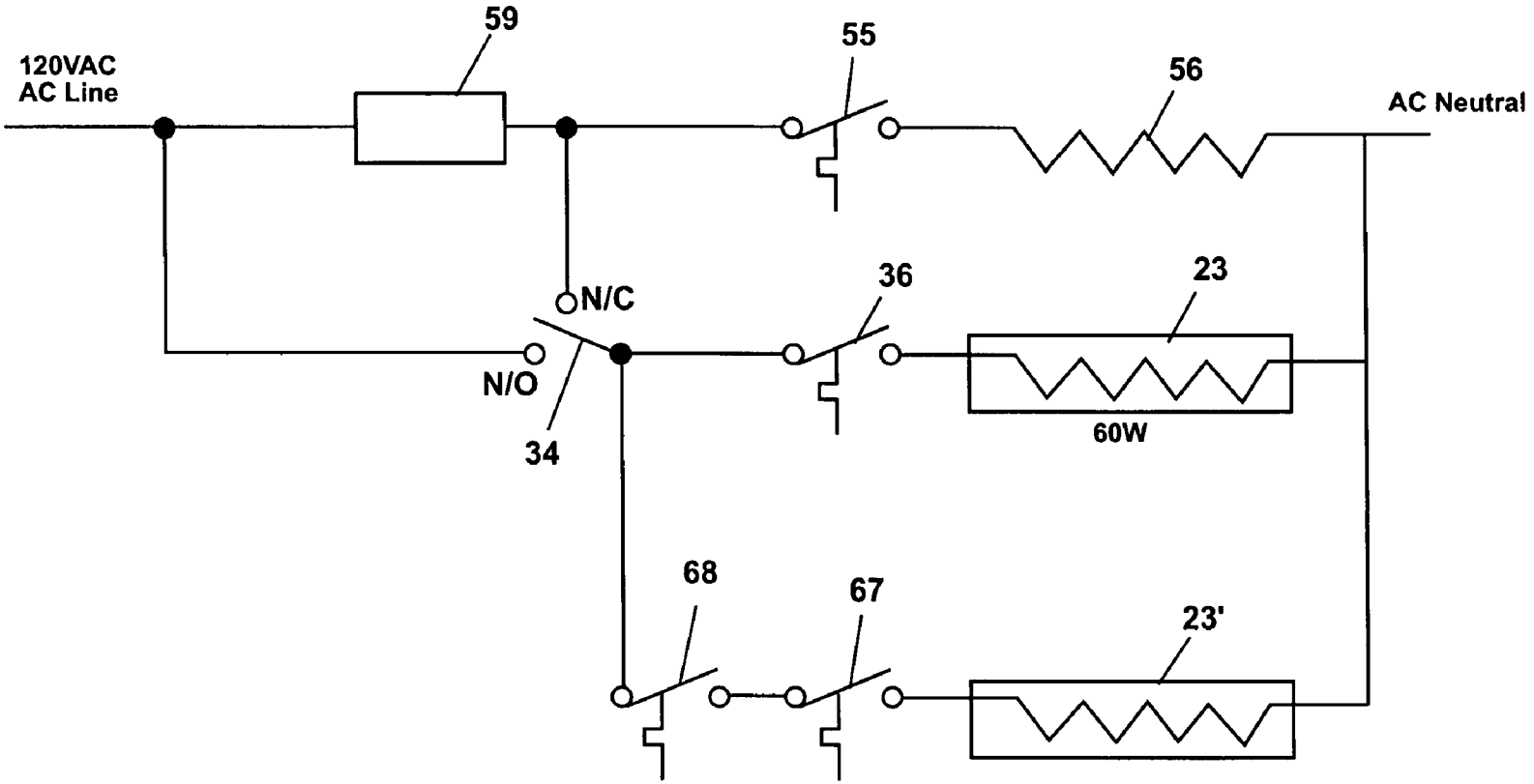
FIG. 9B is a partial circuit diagram for the refrigerator freezer having low ambient heaters as shown in FIG. 7A.

As shown in FIG. 9B, low ambient heaters 23' can be connected through low ambient thermostat 67 in parallel with auxiliary heater 23 and upper compartment thermostat 36. An upper compartment bi-metal thermostat 68 can be connected in circuit with low ambient heaters 23' and low ambient thermostat 67, if desired, to protect against temperatures in upper compartment 13 above normal refrigerator temperatures as will be described below. When control switch 34 is set for operation of the upper compartment as an above freezing refrigerator compartment, contacting the normally open terminal (N/O), low ambient heaters 23' operate to provide supplemental heat to upper compartment 13 under control of low ambient thermostat 67 in low ambient conditions. Low ambient thermostat 67 can be located in the machinery compartment 8 or other location on the convertible refrigerator-freezer to sense ambient conditions outside the refrigerated compartments. Low ambient thermostat 67 can be arranged to close at ambient temperatures lower than normally experienced by a refrigerator freezer to provide additional heat to the upper compartment to help assure that temperatures in the compartment stay above freezing when the upper compartment is operated as an above freezing refrigerator compartment. In the embodiment shown in FIG. 7A low ambient thermostat can be selected to close at 55° F. In the embodiment shown in FIG. 7A, an upper compartment bi-metal thermostat 68 can be provided to sense temperature conditions in the upper compartment and can be arranged to open when the temperature in upper compartment 13 rises to above normal refrigerator compartment temperatures. In the embodiment shown in FIG. 7A bi-metal thermostat 68 can be arranged to open at 45° F. Such above normal temperatures can result from the addition of quantity of warm food to the upper compartment when the ambient conditions around the refrigerator freezer are low so that the low ambient heaters 23' are operating. Once the refrigeration system operates for a period of time the temperature in the upper compartment will fall to normal refrigerator temperatures and the low ambient heaters 23' can be energized under control of the low ambient thermostat 67. Upper compartment bi-metal thermostat 68 can also protect the upper compartment liner in the event of system refrigerant loss due to low ambient conditions by de-energizing low ambient heaters 23' in the absence of cooling for the upper compartment. Upper compartment bi-metal thermostat 68 can be located on or adjacent the evaporator 50, or can be located in the control 30 as will be readily understood by those skilled in the art. The "always refrigerator" upper compartment embodiment described above and shown in FIG. 6A and FIG. 9A can have an upper compartment liner 17' including low ambient heaters 23' that operate in manner as described in this paragraph.

Figure 11:
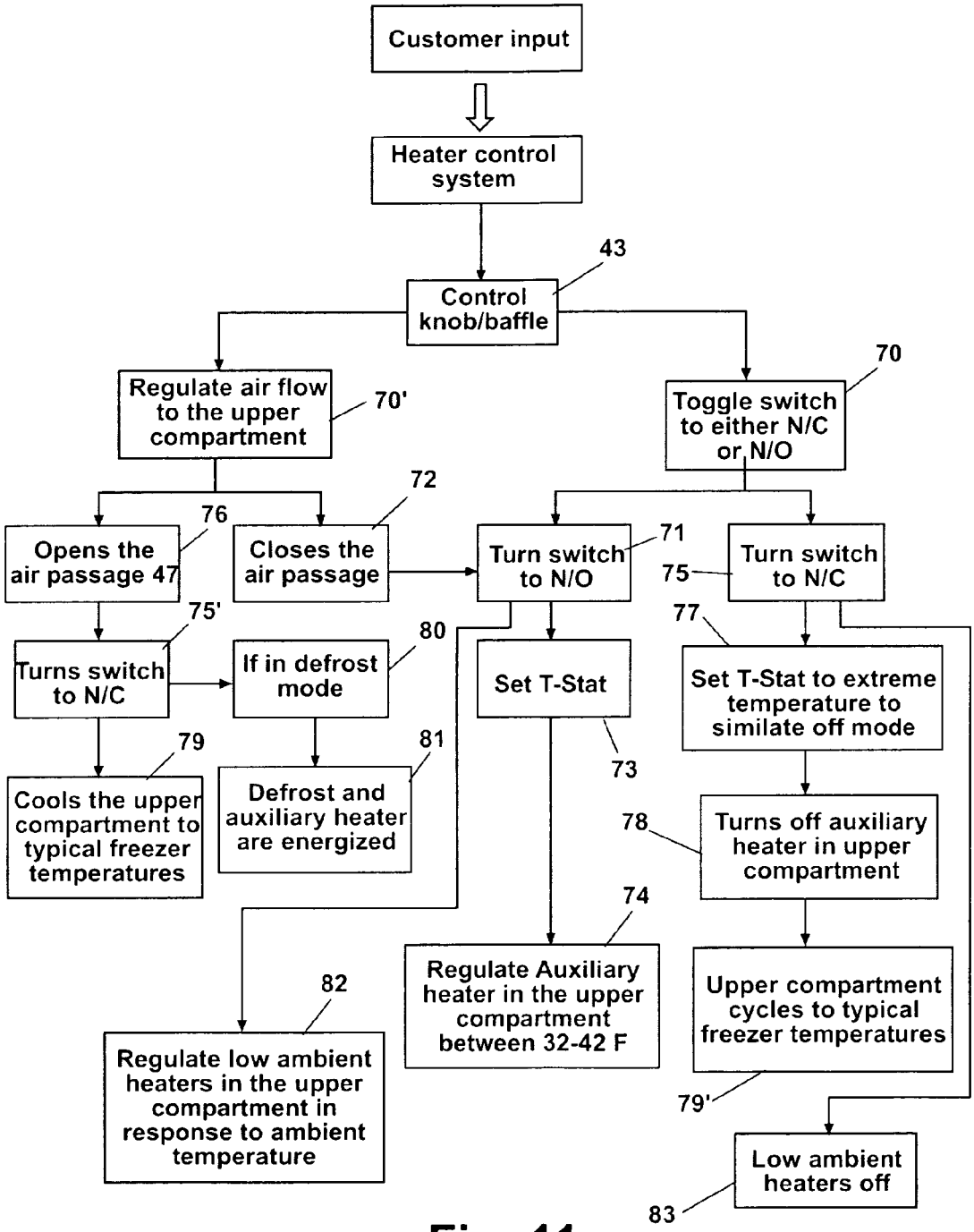
FIG. 11 is a flowchart showing the effect of operating the control between refrigerator and freezer settings for a refrigerator freezer having low ambient heaters as shown in FIG. 7A.

Referring to FIG. 11, the function of the control circuit incorporating low ambient heaters as shown in FIG. 9B is shown in block diagram form. When control knob 43 is rotated to the refrigerator setting position, blocks 70 and 70', control knob 43 can position control switch 34 to complete a circuit connecting terminal N/O to upper compartment thermostat 36, block 71, and to upper compartment bi-metal thermostat 68, block 82, and control baffle 33 can close air passage 47 reducing the flow of refrigerated air into upper compartment 13, block 72. As described above, control baffle 33 closes air passage 47 by rotating cutout 39 out of alignment with air passage 47. Rotation of control knob 43 to the refrigerator position can also rotates drive shaft 42 to operate adjustable thermostat 36 for operation at above freezing temperatures, block 73. For example, thermostat 36 can be arranged to control upper compartment temperatures between 32°–42° F. when control knob 43 is set for refrigerator operation, block 74. When the temperature in upper compartment 13 falls below the set point of thermostat 36, auxiliary heater 23 is energized causing auxiliary heater 23 to add heat to upper compartment 13. Auxiliary heater 23 can operate until the temperature in upper compartment 13 rises to the point that thermostat 36 opens causing heater to be de-energized until the temperature in upper compartment falls to the point that thermostat 36 again closes. Upper compartment thermostat 36 can operate auxiliary heater 23 to provide heat to upper compartment 13 regardless of the ambient temperature around the refrigerator freezer. Low ambient thermostat 67 can operate low ambient heaters 23' in response to ambient temperature around the refrigerator freezer. When ambient temperature around the refrigerator freezer falls below the set point of low ambient thermostat 67, low ambient heaters 23' are energized, block 82. If a normally closed upper compartment bi-metal thermostat 68 is provided, operation of low ambient heaters 23' is controlled by both low ambient thermostat 67 and upper compartment bi-metal thermostat 68. If low ambient thermostat 67 senses ambient temperatures below the set point, low ambient heaters 23' are energized provided temperatures in the upper compartment are in the normal refrigerator range so that upper compartment bi-metal thermostat 68 is closed. If the ambient temperature rises thermostat 67 will open de-energizing low ambient heaters 23'. Likewise, if temperatures in the upper compartment are above normal refrigerator temperatures upper compartment bi-metal thermostat 68 will open de-energizing low ambient heaters 23'. Thus, auxiliary heater 23 and low ambient heater(s) 23' can provide heat to prevent the temperature in upper compartment 13 from falling below freezing even if the ambient temperature outside the refrigerator is near or below freezing.

When control knob 43 is rotated to a freezer setting position, block 70 and 70', control knob 43 rotates control baffle 33 to position cam 40 so that switch 34 reverts to the N/C position, block 75 and block 75', and positions cutout 39 to be partially or fully aligned with air passage 47 and louvers 37 thus increasing refrigerated airflow into upper compartment 13, block 76 to achieve typical freezer temperatures, block 79 and block 79'. Upper compartment thermostat 36 is adjusted to assure thermostat 36 will remain closed to connect the N/C terminal of switch 34 to the auxiliary heater 23, block 77. With control switch 34 in the N/C position auxiliary heater 23 and low ambient heater(s) 23' are normally de-energized so that no additional heat is added to upper compartment 13, block 78 and block 83. Low ambient heaters 23' are energized during defrost as is the case with the auxiliary heater 23 if ambient temperatures are low enough to close low ambient thermostat 67, block 80 and block 81. Those skilled in the art will understand that the embodiments of the refrigerator freezer control described above and shown in FIG. 9 through FIG. 11 can take other well known forms including electronic controls, electronic temperature sensors and electronic switches in place of the control elements disclosed above.

Figure 7:
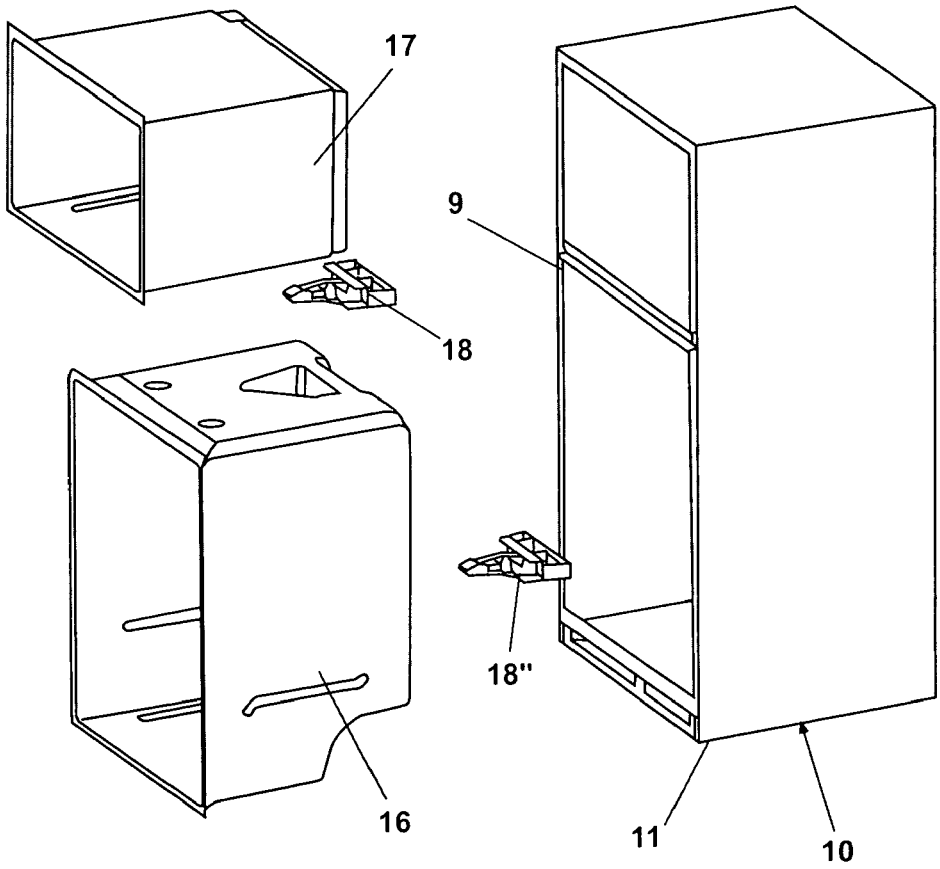
FIG. 7 is an exploded partial front perspective view showing the upper and lower compartment liners and the cabinet of the refrigerator freezer.

An advantage of the convertible compartment refrigerator according to the invention is that the major components are common with a conventional top freezer refrigerator freezer. By sharing major components the tooling and capital cost of producing a convertible compartment refrigerator can be greatly reduced. Further, since major components are common, conventional top freezer and convertible refrigerator freezers can be produced on the same assembly line without undue complication. Referring to FIG. 7, the cabinet 11 and compartment liners are shown in an exploded view. Assembly of convertible refrigerator freezers can include the following primary steps: form cabinet 11; thermoform upper and lower compartment liners 17 and 16; attach compartment separator 18 or 18" to upper compartment liner 17, and if applicable, attach low ambient heaters 23' on liner 17 to form liner 17'; install refrigerant lines (not shown), including a heat loop (not shown) for the cabinet front flange area, in cabinet 11 leading from the machinery compartment 8 at the bottom rear of the cabinet to the area behind the upper compartment; install suitable wiring harnesses (not shown) from the machinery compartment to locations on the cabinet where electrical components will be mounted on the upper or lower compartment liners; install the upper compartment liner 17 or 17' in the cabinet by inserting flanges on liner 17 or 17' into channels formed on the front edge of cabinet 11; install cabinet rail 9 to hold upper compartment liner 17 or 17' in place; install lower compartment liner 16 by inserting flanges on liner 16 into channels formed on the front edge of cabinet 11 and cabinet rail 9; and inject foam in place insulation (not shown) in the spaces between cabinet 11 and liners 16 and 17 or 17' using conventional foam in place equipment as is well known in the art. At this point in the manufacture of the convertible refrigerator freezer the only components not common with a conventional top freezer refrigerator are the low ambient heaters 23' on upper compartment liner 17' if used, compartment separator 18 and the refrigerant line set including the heat loop. As those skilled in the art will readily understand, in the case of a conventional refrigerator freezer the heat loop (not shown) can extend around the front flange of the upper compartment liner to keep moisture from condensing on the cabinet flange adjacent the freezer compartment in operation. In the case of a convertible refrigerator freezer the heat loop (not shown) can extend around the front flange of both the upper and lower compartment liners since both compartments can be operated as a freezer compartment. Thus, to change from convertible refrigerator freezer manufacture to conventional refrigerator freezer manufacture it is only necessary to substitute conventional compartment separator 18" for compartment separator 18, omit low ambient heaters 23' and install the appropriate refrigerant line set and heat loop. In addition, a separate wiring harness could be provided for the convertible refrigerator freezer. However, none of the compartment separator, refrigerant line set and heat loop, low ambient heaters or wiring harness are major capital tooling components.

Following assembly and foaming of the cabinet and liners, the remaining refrigeration system and control components can be assembled. To assemble a convertible refrigerator freezer the evaporator 50 and mounting bracket 51 can be installed. After a compressor (not shown), a condenser (not shown) and an expansion device (not shown) are installed in the machinery compartment 8, the refrigeration system can be connected to the refrigerant line set and heat loop (not shown) assembled to the cabinet prior to application of foam in place insulation and the system can be evacuated and charged with refrigerant as is well known in the art. After completion of the refrigerant circuit, evaporator fan assembly 54 can be connected and installed in the rear of upper compartment 13. Then, evaporator cover assembly 20 can be installed. To install evaporator cover assembly 20, inner evaporator cover 27 can be installed followed by air tower 26. Next, insulation block 25 can be positioned over air tower 26. Evaporator cover 21 can be installed with auxiliary heater 23 attached followed by upper compartment drain pan 22. Last, control 30 or 30' can be connected and installed on the face of outer evaporator cover 21. Alternately, the evaporator cover assembly 20 could be assembled as a subassembly and installed in upper compartment in one piece as will be understood by those skilled in the art. Following completion of installation of the outer evaporator cover assembly remaining interior components can be completed and doors 14 and 15 can be installed as is well known to those skilled in the art.

Figure 8:
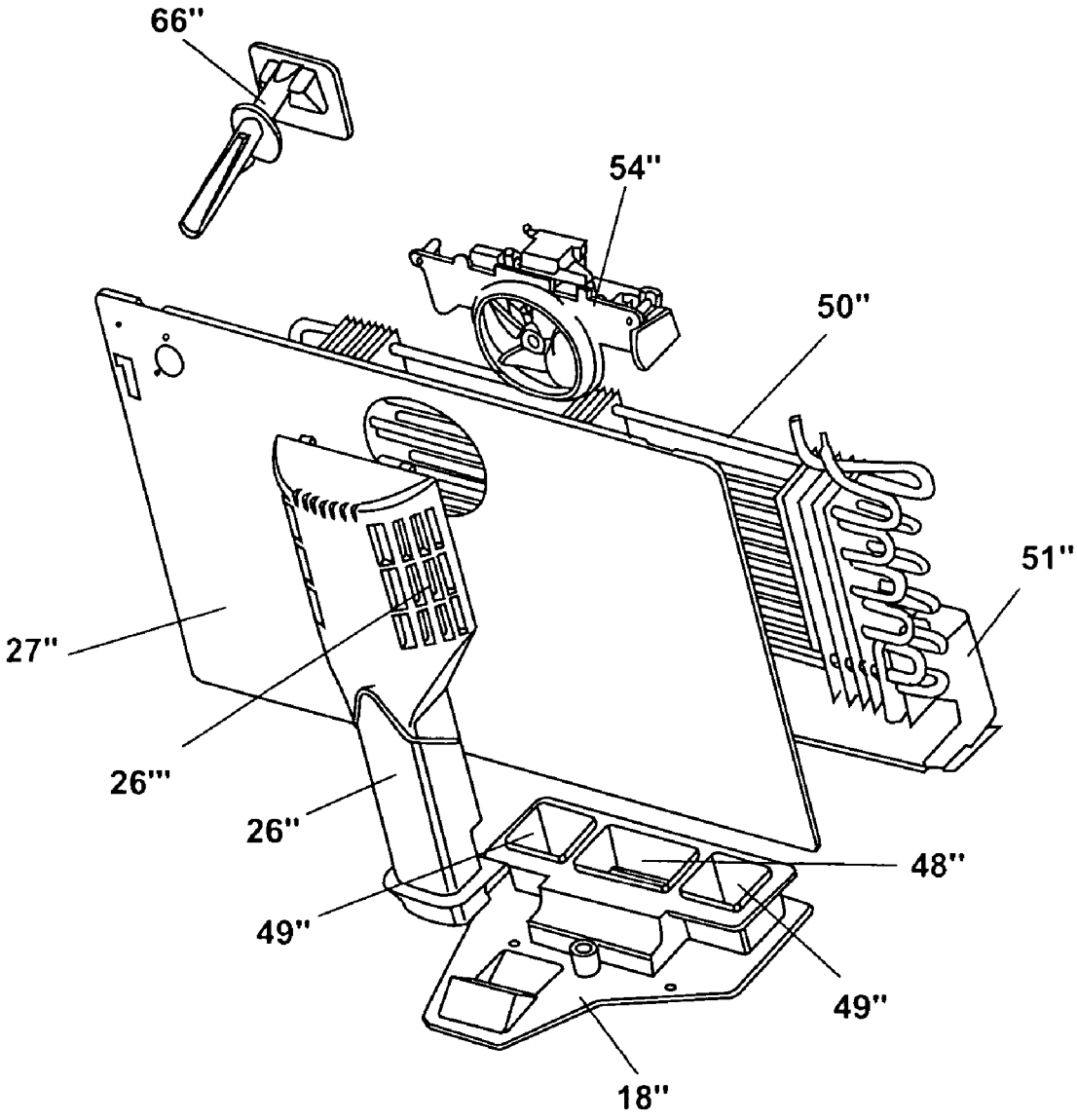
FIG. 8 is an exploded partial front perspective view of the evaporator and evaporator cover of a conventional top freezer refrigerator.

Referring to FIG. 8, an evaporator and evaporator cover assembly for a conventional top freezer refrigerator can be seen. Evaporator 50" can be installed in the rear of upper compartment 13' with bracket 51". Evaporator fan assembly 54" can be provided to draw air over evaporator 50" and discharge the refrigerated air through an opening in evaporator cover 27" into air tower 26". Air tower 26" conveys a portion of the refrigerated air down air tower 26" through compartment separator 18" through air passage 48" into lower compartment 12. Air tower 26" includes louvers 26'" to convey refrigerated air into upper compartment 13. Return air passages 49" in compartment separator 18" can allow air from lower compartment 12 to be drawn into evaporator 50" by evaporator fan assembly 54". The control circuit for a conventional top freezer refrigerator freezer can be the same as the control circuit shown in FIG. 9 with switch 34, upper compartment thermostat 36 and auxiliary heater 23 eliminated. As in the embodiment shown in FIG. 1 to FIG. 7, an optional ice maker fill tube assembly 66" can be provided. The elements described in this paragraph that have been identified with a double prime mark correspond to the same element in the convertible refrigerator freezer embodiment. The "double prime" elements in the conventional refrigerator freezer function generally in the same manner as the corresponding elements in the convertible refrigerator freezer embodiment except as noted in this paragraph. While doors for a conventional top freezer refrigerator have not been shown, those skilled in the art will recognize that the inner door panels can be the same as shown in FIG. 1 or modified as desired. In the case of the embodiment shown in FIG. 1, the inner door for the lower compartment 14 can be the same as the inner door for a conventional top freezer refrigerator (conventional door shelves and storage features are not shown). Also, in the case of the embodiment shown in FIG. 1, the inner door for the upper compartment 15 can be similar to the inner door for a conventional top freezer refrigerator. The inner door of the convertible refrigerator freezer can be provided with a can or bottle rack, not shown, in place of customary shelves, not shown, that can be provided on the inner door of a conventional top freezer refrigerator.

Thus, the convertible refrigerator freezer according to the invention can be cost effectively produced since all major structural components are common with a conventional top freezer refrigerator. Only the compartment separator 18, 18", low ambient heaters if used, and refrigeration system components differ between the conventional and convertible refrigerator freezers outside the evaporator cover assembly. In addition, the convertible refrigerator freezer and the "always refrigerator" upper compartment embodiments according to this invention provide superior freezer performance in the lower freezer compartment due to the location of the evaporator and defrost heater in the upper compartment. Further, the convertible refrigerator freezer and "always refrigerator" upper compartment embodiments enable use of the refrigerator freezer according to the invention in low ambient temperature conditions without subjecting fresh food stored in upper compartment 13 set to operate as an above freezing refrigerator compartment to below freezing conditions.

While the invention has been specifically described in connection with certain specific embodiments thereof, it is to be understood that this is by way of illustration and not of limitation, and the scope of the appended claims should be construed as broadly as the prior art will permit.

We claim:

1. A convertible refrigerator freezer comprising:

an insulated cabinet having an upper convertible compartment selectively operable by the user as an above freezing refrigerator compartment or as a below freezing freezer compartment, and a lower below freezing freezer compartment;

insulation between the upper convertible compartment and the lower freezer compartment;

a refrigerating system for the convertible refrigerator freezer including:

an evaporator mounted adjacent the rear wall of the upper convertible compartment;

an evaporator cover forming an evaporator compartment for separating the evaporator from the upper convertible compartment;

an evaporator fan mounted in the evaporator compartment for drawing air from the lower freezer compartment through the insulation between the compartments and from the upper convertible compartment and circulating the air over the evaporator;

an air tower for conveying refrigerated air from the evaporator fan to the lower freezer compartment through the insulation between the compartments; and a control for selectively discharging a first amount of refrigerated air through the evaporator cover to the upper convertible compartment when the control is set for operating the upper compartment as an above freezing refrigerator compartment, or a second larger amount of refrigerated air through the evaporator cover to the upper convertible compartment when the control is set for operating the upper convertible compartment as a freezer compartment.

2. The convertible refrigerator freezer of claim 1 wherein the refrigerating system is frost free and includes a defrost heater adjacent the evaporator and a defrost control for periodically energizing the defrost heater for melting accumulated frost and ice on the evaporator.

3. The convertible refrigerator freezer of claim 1 wherein the evaporator cover includes an inner evaporator cover overlying the evaporator and an insulated outer evaporator cover separating the evaporator from items stored in the upper convertible compartment.

4. The convertible refrigerator freezer of claim 3 wherein the control for selectively discharging refrigerated air to the upper convertible compartment includes a manually operated control baffle arranged to open or close an air passage allowing refrigerated air to flow from the evaporator through the evaporator cover to cool items stored in the upper convertible compartment.

5. The convertible refrigerator freezer of claim 4 wherein the control includes a rotary knob connected to the manually operated control baffle for rotating the baffle to a first position substantially closing the air passage and to a second position allowing free movement of refrigerated air through the air passage.

6. The convertible refrigerator freezer of claim 1 wherein the lower below freezing freezer compartment comprises more than half of the internal volume of the convertible refrigerator freezer.

7. The convertible refrigerator freezer of claim 6 wherein the lower below freezing freezer compartment comprises approximately 70% of the internal volume of the convertible refrigerator freezer.

8. A refrigerator freezer comprising:

an insulated cabinet having an upper compartment operable as an above freezing refrigerator compartment, and a lower below freezing freezer compartment;

insulation between the upper compartment and the lower freezer compartment;

a refrigerating system for the refrigerator freezer including:

an evaporator mounted adjacent the rear wall of the upper compartment;

an evaporator cover forming an evaporator compartment for separating the evaporator from the upper compartment;

an evaporator fan mounted in the evaporator compartment for drawing air from the lower freezer compartment through the insulation between the compartments and from the upper compartment and circulating the air over the evaporator;

a defrost heater adjacent the evaporator for periodically defrosting the evaporator;

an air tower for conveying refrigerated air from the evaporator fan to the lower freezer compartment through the insulation between the compartments and to the upper compartment;

a defrost control for periodically defrosting the evaporator during defrost cycles by energizing the defrost heater; and a control for adjusting the temperature of the upper compartment including an auxiliary heater for the upper compartment and connected in circuit with an upper compartment thermostat to maintain the temperature in the upper compartment above freezing.

9. The refrigerator freezer of claim 8 wherein the lower below freezing freezer compartment comprises approximately 70% of the internal volume of the refrigerator freezer.

10. The refrigerator freezer of claim 8 wherein the upper compartment is selectively operable by the user as an above freezing refrigerator compartment or as a below freezing freezer compartment, and the control includes a manually operated control baffle for selectively discharging a first amount of refrigerated air through the evaporator cover to the upper compartment when the control is set for operating the upper compartment as an above freezing refrigerator compartment, or a second larger amount of refrigerated air through the evaporator cover to the upper compartment when the control is set for operating the upper compartment as a freezer compartment.

11. The refrigerator freezer of claim 10 wherein the auxiliary heater is connected to be energized by the defrost control in addition to the defrost heater during defrost cycles when the control is set for freezer operation.

12. The refrigerator freezer of claim 8 wherein the evaporator cover includes an inner evaporator cover overlying the evaporator and an insulated outer evaporator cover separating the evaporator from items stored in the upper compartment.

13. The refrigerator freezer of claim 12 wherein the auxiliary heater is located between the insulation and the outer cover of the insulated outer cover.

14. The refrigerator freezer of claim 8 wherein the upper compartment further includes one or more low ambient heaters for the upper compartment connected to a power supply in circuit with a low ambient thermostat arranged to respond to temperature conditions outside the refrigerator freezer to provide heat to the upper compartment when ambient conditions are near to or below freezing to assure that temperatures in the upper compartment remain above freezing.

15. The refrigerator freezer of claim 10 wherein the upper compartment further includes one or more low ambient heaters for the upper compartment connected in circuit with a power supply and a low ambient thermostat arranged to respond to temperature conditions outside the refrigerator freezer to provide heat to the upper compartment when ambient conditions are near to or below freezing to assure that temperatures in the upper compartment remain above freezing when the control is set for operating the upper compartment as an above freezing refrigerator compartment.

16. A convertible refrigerator freezer comprising:

an insulated cabinet having an upper convertible compartment selectively operable by the user as an above freezing refrigerator compartment or as below freezing freezer compartment, and a lower below freezing freezer compartment;

insulation between the upper convertible compartment and the lower freezer compartment;

a refrigerating system for the convertible refrigerator freezer including:

an evaporator mounted adjacent the rear wall of the upper convertible compartment;

an evaporator cover forming an evaporator compartment for separating the evaporator from the upper convertible compartment;

an evaporator fan mounted in the evaporator compartment for drawing air from the lower freezer compartment and from the upper convertible compartment and circulating the air over the evaporator;

a defrost heater adjacent the evaporator for periodically defrosting the evaporator an air tower for conveying refrigerated air from the evaporator fan to the lower freezer compartment through the compartment separator;

a defrost control for periodically defrosting the evaporator; and a control for setting the convertible compartment to operate as an above freezing refrigerator or as a below freezing freezer compartment including:

an air controller for selectively discharging a first amount of refrigerated air through the evaporator cover to the upper convertible compartment when the upper convertible compartment is operated as an above freezing refrigerator compartment, or a second larger amount of refrigerated air through the evaporator cover to the upper convertible compartment when the upper convertible compartment is operated as a below freezing freezer compartment; and an auxiliary heater for the upper convertible compartment and connected in circuit with a convertible compartment thermostat to maintain the upper convertible compartment at above freezing temperatures when the control is set for refrigerator operation.

17. The convertible refrigerator freezer of claim 16 wherein the air controller includes a control baffle to control the discharge of refrigerated air through the evaporator cover into the convertible compartment and to operate a switch to connect the auxiliary heater and convertible compartment thermostat to a power supply when the control is set for refrigerator operation.

18. The convertible refrigerator freezer of claim 17 wherein the air controller further includes a first set of louvers in the control, and the control baffle comprises a rotatable baffle mounted on a shaft, the rotatable baffle having cutout opening arranged to selectively align with an air passage from the air tower through the evaporator cover into the upper convertible compartment, whereby when the baffle cutout is aligned with the air passage the second larger amount of air passes into the upper convertible compartment through the baffle cutout and the first set of louvers when the evaporator fan is operating.

19. The convertible refrigerator freezer of claim 17 wherein the control includes a rotary knob connected to the control baffle for rotating the control baffle to a first position for closing the air passage and thereby discharging the first amount of refrigerated air to the upper convertible compartment and to a second position for discharging the second amount of refrigerated air to the upper convertible compartment, and the control baffle includes a cam on the baffle for operating the switch to connect the auxiliary heater and convertible compartment thermostat when the control is set for refrigerator operation.

20. The convertible refrigerator freezer of claim 16 wherein the auxiliary heater is connected to be energized by the defrost control in addition to the defrost heater during defrost cycles when the control is set for freezer operation.

21. The refrigerator freezer of claim 16 wherein the upper convertible compartment further includes one or more low ambient heaters for the upper compartment connected to a power supply in circuit with a low ambient thermostat arranged to respond to temperature conditions outside the refrigerator freezer to provide heat to the upper convertible compartment when ambient conditions are near to or below freezing to assure that temperatures in the upper convertible compartment remain above freezing, and the one or more low ambient heaters, and low ambient thermostat are connected to the power supply when the control is set for operating the upper compartment as an above freezing refrigerator compartment.

22. A convertible refrigerator freezer comprising:

an insulated cabinet having an upper convertible compartment selectively operable by the user as an above freezing refrigerator compartment or as a below freezing freezer compartment, and a lower below freezing freezer compartment;

insulation and a compartment separator between the upper convertible compartment and the lower freezer compartment;

an evaporator compartment in the rear of the upper convertible compartment formed by an evaporator cover assembly spaced from the rear wall of the upper convertible compartment including;

an inner evaporator cover spaced inwardly from the rear wall of the convertible compartment;

an air tower overlying the inner evaporator cover and connecting an opening in the inner evaporator cover to an opening in the compartment separator for supplying refrigerated air from the evaporator compartment to the freezer compartment;

a sheet of insulation material overlying the inner evaporator cover and the air tower;

an outer evaporator cover overlying the insulation material;

a refrigerating system for the convertible refrigerator freezer including:

an evaporator mounted in the evaporator compartment;

an evaporator fan mounted in the evaporator compartment for drawing air from the lower freezer compartment through the compartment separator and from the upper convertible compartment and circulating the air over the evaporator and discharging refrigerated air into the air tower for cooling the lower freezer compartment and the upper convertible compartment; and a control for selectively discharging a first amount of refrigerated air from the air tower through the evaporator cover to the upper convertible compartment when the control is set to operate the upper convertible compartment as an above freezing refrigerator compartment, and for discharging a second larger amount of refrigerated air through the evaporator cover to the upper convertible compartment when the control is set to operate the upper convertible compartment as a below freezing freezer compartment.

23. The convertible refrigerator freezer of claim 22 wherein the outer evaporator cover is cooled by the evaporator through the insulation material to provide additional cooling to the upper convertible compartment.

24. The convertible refrigerator freezer of claim 22 further including a defrost heater adjacent the evaporator, a defrost control for periodically energizing the defrost heater to defrost the evaporator, and an auxiliary heater for the upper convertible compartment and connected in circuit with a convertible compartment thermostat, and wherein the control operates a switch to connect the auxiliary heater and convertible compartment thermostat to a power supply when the control is set for refrigerator operation to supply heat to the upper convertible compartment under control of the convertible compartment thermostat during above freezing operation.

25. The convertible refrigerator freezer of claim 24 wherein the auxiliary heater is mounted adjacent the outer evaporator cover.

26. The refrigerator freezer of claim 24 wherein the upper convertible compartment further includes one or more low ambient heaters for the upper convertible compartment connected to a power supply in circuit with a low ambient thermostat arranged to respond to temperature conditions outside the refrigerator freezer to provide heat to the upper convertible compartment when ambient conditions are near to or below freezing to assure that temperatures in the upper convertible compartment remain above freezing, and the one or more low ambient heaters, and low ambient thermostat are connected to the power supply when the control is set for operating the upper convertible compartment as an above freezing refrigerator compartment.

27. The refrigerator freezer of claim 26 wherein the low ambient heaters are located adjacent the outer surface of the sidewalls of the upper convertible compartment.

28. A convertible refrigerator freezer comprising:

an insulated cabinet having an upper convertible compartment selectively operable by the user as an above freezing refrigerator compartment or as a below freezing freezer compartment, and a lower below freezing freezer compartment;

insulation between the upper convertible compartment and the lower freezer compartment;

a refrigerating system for the convertible refrigerator freezer including:

an evaporator mounted adjacent the rear wall of the upper convertible compartment;

an insulated evaporator cover for separating the evaporator from the upper convertible compartment;

a defrost heater adjacent the evaporator;

a defrost control for periodically energizing the defrost heater for melting accumulated frost and ice on the evaporator;

an evaporator fan mounted in the upper convertible compartment for drawing air from the lower freezer compartment and the upper convertible compartment and circulating the air over the evaporator and to the upper convertible compartment and the lower freezer compartment;

an auxiliary heater for the upper convertible compartment and connected in circuit with a convertible compartment thermostat and a selector switch operable to a first position to connect the auxiliary heater and convertible compartment thermostat to a power supply; and a control for selectively permitting discharge of a first amount of refrigerated air to the upper convertible compartment and for operating the selector switch to the first position when the control is set to operate the upper convertible compartment as an above freezing refrigerator compartment.

29. The convertible refrigerator freezer of claim 28 wherein the control operates the selector switch to a second position when the control is set to operate the upper convertible compartment as a freezer compartment and, in the second position, the selector switch connects the auxiliary heater and convertible compartment thermostat in circuit with the defrost heater to operate under control of the defrost control to provide additional heat during defrosting.

30. The convertible refrigerator freezer of claim 29 wherein the control permits discharge of a first amount of refrigerated air from the evaporator fan to the upper convertible compartment when the control is set to operate the upper convertible compartment as an above freezing refrigerator compartment, and the control permits discharge of a second larger amount of refrigerated air from the evaporator fan to the upper convertible compartment when the control is set to operate the upper convertible compartment as a below freezing freezer compartment.

31. The convertible refrigerator freezer of claim 30 wherein the control includes a rotary knob connected to a control baffle for rotating the control baffle to a first position for permitting discharge of the first amount of refrigerated air to the upper convertible compartment and to a second position for permitting discharge of the second amount of refrigerated air to the upper convertible compartment, and the control baffle includes a cam for operating the selector switch to the first position when the control is set to operate the upper convertible compartment as an above freezing refrigerator and to the second position when the control is set to operate the upper convertible compartment as a below freezing freezer.

32. The refrigerator freezer of claim 28 wherein the upper convertible compartment further includes one or more low ambient heaters adjacent the outer surface of the sidewalls of the upper convertible compartment connected to a power supply in circuit with a low ambient thermostat arranged to respond to temperature conditions outside the refrigerator freezer and an upper compartment bi-metal thermostat to respond to temperature conditions in the upper convertible compartment to provide heat to the upper convertible compartment when ambient conditions are near to or below freezing to assure that temperatures in the upper convertible compartment remain above freezing but below above normal refrigerator compartment temperatures, and the one or more low ambient heaters, low ambient thermostat and upper compartment bi-metal thermostat are connected to the power supply when the control is set for operating the upper convertible compartment as an above freezing refrigerator compartment.

33. A method of manufacturing (i) a refrigerator freezer product having an upper freezer compartment and a lower refrigerator compartment configuration, or (ii) a convertible refrigerator freezer product having an upper convertible compartment selectively operable as an above freezing refrigerator compartment or as a below freezing freezer compartment and a lower freezer compartment configuration utilizing a common platform comprising:

providing a common cabinet for use with both product configurations;

providing common compartment liners for use with both product configurations;

providing a first compartment separator for use in the refrigerator freezer product configuration or a second compartment separator for use in the convertible refrigerator freezer product configuration;

providing a first air system for supplying refrigerated air from an evaporator and evaporator fan in the upper freezer compartment to the upper freezer compartment and lower refrigerated compartment in the refrigerator freezer product configuration including an air tower for directing refrigerated air from the evaporator to the lower refrigerated compartment and to the upper freezer compartment, or providing a second air system for supplying refrigerated air from an evaporator and evaporator fan in the upper convertible compartment to the upper convertible compartment and to the lower freezer compartment in the convertible refrigerator freezer product configuration including an air tower for directing refrigerated air from the evaporator fan to the lower freezer compartment and a control for selectively directing a first amount of refrigerated air from the evaporator fan to the upper convertible compartment when the convertible upper compartment is operated as an above freezing refrigerator compartment, and a second larger amount of refrigerated air to the upper convertible compartment when the upper convertible compartment is operated as a freezer compartment.

34. The method of manufacturing (i) a refrigerator freezer product or (ii) a convertible refrigerator freezer product of claim 33 further comprising:

providing a first refrigeration system for use in the refrigerator freezer product configuration, or a second refrigeration system for use in the convertible refrigerator freezer product configuration.

35. The method of manufacturing (i) a refrigerator freezer product or (ii) a convertible refrigerator freezer product of claim 33 further comprising:

providing a common door for the lower compartment; and providing a door with a first inner door panel for the refrigerator freezer product or a door with a second inner door panel for the convertible refrigerator freezer product for the upper compartment.

36. The method of manufacturing (i) a refrigerator freezer product or (ii) a convertible refrigerator freezer product of claim 33 further comprising:

providing a first control system for the refrigerator freezer product, or a second control system for the convertible refrigerator freezer product.

37. A method of manufacturing (i) a refrigerator freezer product having an upper freezer compartment and a lower refrigerator compartment configuration, or (ii) a convertible refrigerator freezer product having an upper convertible compartment selectively operable as an above freezing refrigerator compartment or as a freezer compartment and a lower freezer compartment configuration utilizing a common platform and a common assembly process comprising:

fabricating a common cabinet for use with both product configurations;

fabricating a common upper compartment liner and a common lower compartment liner for use in both product configurations;

assembling a first compartment separator to the upper compartment liner for the refrigerator freezer product configuration, or assembling a second compartment separator to the upper compartment liner for the convertible refrigerator freezer product configuration;

assembling a wiring harness in the common cabinet for connecting electrical components in the upper and lower compartment liners;

assembling a first refrigerant line and heat loop set in the common cabinet for the refrigerator freezer product configuration, or assembling a second refrigerant line and heat loop set in the common cabinet for the convertible refrigerator freezer product configuration;

assembling the upper compartment liner to the cabinet;

assembling the lower compartment liner to the cabinet;

providing foam in place insulation between the cabinet and the liners;

assembling a first refrigeration system including an evaporator, defrost heater, condenser and compressor in the refrigerator freezer product configuration, or a second refrigeration system including an evaporator, defrost heater, condenser and compressor in the convertible refrigerator freezer product configuration;

assembling a first evaporator cover including an air tower for transmitting refrigerated air to the lower refrigerator compartment and to the upper freezer compartment in the refrigerator freezer product configuration, or a second evaporator cover assembly including an inner evaporator cover, an air tower for transmitting refrigerated air from the evaporator fan to the lower freezer compartment, a sheet of insulation material and an outer evaporator cover in the convertible refrigerator freezer product configuration; and assembling a first control for controlling operation of a refrigerator freezer product configuration, or a second control for controlling operation of a convertible product configuration wherein the second control includes an air controller for selectively directing a first amount of refrigerated air from the evaporator fan to the upper convertible compartment for operation as an above freezing refrigerator, or a second larger amount of refrigerated air to the convertible compartment for operation as a below freezing freezer;

assembling a common lower compartment door and door liner; and assembling a common upper door having a first inner door for the refrigerator freezer product configuration, or a common upper door having a second inner door for the convertible refrigerator freezer product configuration.

38. The method of manufacturing (i) a refrigerator freezer having an upper freezer compartment and a lower refrigerator compartment configuration, or (ii) a convertible refrigerator freezer product having an upper convertible compartment selectively operable as an above freezing refrigerator compartment or as a freezer compartment and a lower freezer compartment as in claim 37 wherein the step of assembling a wiring harness in the common cabinet comprises assembling a first wiring harness in the cabinet for the refrigerator freezer product configuration, or assembling a second wiring harness in the cabinet for the convertible refrigerator freezer product configuration.

* * * * *